US007148617B2

(12) United States Patent
Miura et al.

(10) Patent No.: US 7,148,617 B2
(45) **Date of Patent: *Dec. 12, 2006**

(54) FLAT CATHODE-RAY TUBE INCLUDING A TRANSFER FOIL LAMINATE ADHERED TO A SCREEN PANEL

(75) Inventors: Jun Miura, Fukushima (JP); Koichi Furui, Kanagawa (JP)

(73) Assignee: Sony Corporation (JP)

( * ) Notice: Subject to any disclaimer, the term of this patent is extended or adjusted under 35 U.S.C. 154(b) by 97 days.

This patent is subject to a terminal disclaimer.

(21) Appl. No.: 11/099,521

(22) Filed: Apr. 6, 2005

(65) Prior Publication Data

US 2005/0175820 A1 Aug. 11, 2005

Related U.S. Application Data

(63) Continuation of application No. 09/891,246, filed on Jun. 27, 2001, now Pat. No. 6,906,455.

(30) Foreign Application Priority Data

Feb. 26, 2001 (JP) ..... P2001-050877
Feb. 26, 2001 (JP) ..... P2001-050879

(51) Int. Cl.
*H01J 31/00* (2006.01)
*H01J 29/10* (2006.01)

(52) U.S. Cl. ..... 313/479; 313/477 R; 313/461; 156/230; 156/540

(58) Field of Classification Search ..... None
See application file for complete search history.

(56) References Cited

U.S. PATENT DOCUMENTS 3,893,877 A 7/1975 Libman et al.
3,910,806 A 10/1975 Schwart
5,602,442 A 2/1997 Jeong
6,906,455 B1 * 6/2005 Miura et al. ..... 313/479

FOREIGN PATENT DOCUMENTS

GB 1042150 A * 9/1966
JP 54 013767 A 2/1979
JP 11 96948 4/1999
JP 11 224602 A 8/1999
JP 2001-076618 A 3/2001

OTHER PUBLICATIONS

European Search Report and Annex dated Feb. 19, 2004.

* cited by examiner

*Primary Examiner*—Mariceli Santiago
(74) *Attorney, Agent, or Firm*—Rader Fishman & Grauer PLLC; Ronald P. Kananen

(57) ABSTRACT

A reflection type flat cathode-ray tube enhanced in quality of display image, and its manufacturing method are presented. A flat cathode-ray tube is composed by forming a grid layer, a reflective layer, and a fluorescent layer sequentially at the inner side of a screen panel. The reflective layer is preferably formed at the outer side of the circumference of the fluorescent layer. On a transfer substrate, a transfer foil laminating at least a fluorescent layer, a reflective layer, and a grid layer in this order is prepared, the grid layer side of the transfer foil is heated, pressed and adhered to the inner side of a screen panel, a transfer substrate is peeled off, and a fluorescent screen composed of the fluorescent layer, reflective layer, and grid layer is transferred.

1 Claim, 22 Drawing Sheets

FLAT CATHODE-RAY TUBE INCLUDING A TRANSFER FOIL LAMINATE ADHERED TO A SCREEN PANEL

This is a continuation of application Ser. No. 09/891,246, filed Jun. 27, 2001, now U.S. Pat. No. 6,906,455, the entire contents of which are hereby incorporated by reference.

BACKGROUND OF THE INVENTION

1. Field of the Invention

The invention relates to a transfer foil, transfer method, and transfer apparatus used in manufacturing of a fluorescent screen of a flat cathode-ray tube.

The present invention also relates to a flat cathode-ray tube for reproducing video information by illuminating a fluorescent layer by an electron beam, and a method of manufacturing the same.

2. Description of the Related Art

A reflection type or transmission type flat cathode-ray tube is known. For example, the reflection type flat cathode-ray tube is noted for its low manufacturing cost and high image quality. In this kind of flat cathode-ray tube, a fluorescent screen is formed on the screen panel inner side disposed at a position confronting a front panel. The fluorescent screen is prepared by forming a fluorescent screen on a reflective layer. In other known example of fluorescent screen, a transparent grid (ITO film), a reflective layer ($TiO_2$ film) and a fluorescent layer are formed in this sequence.

In a known example of a method for manufacturing a fluorescent screen of such flat cathode-ray tube, when composing the fluorescent screen by forming a transparent grid (ITO film), a reflective layer ($TiO_2$ film) and a fluorescent layer sequentially on the inner side of a screen panel, the reflective layer ($TiO_2$ film) and fluorescent layer are formed by a transfer method, and the transparent grid (ITO film) is formed by an application method (see Japanese Laid-open Patent No. 11-96948).

In other example of a method for manufacturing a fluorescent screen of a flat cathode-ray tube, an aluminum film composed of fluorescent layer and reflective layer is formed on a PET polyethylene terephthalate) film, and the fluorescent screen composed of the fluorescent layer and reflective layer is transferred on the inner side of a screen panel after peeling process. Herein, the fluorescent layer is formed by screen printing, and the aluminum film is formed by screen printing of aluminum paste or vapor deposition. By making use of such transfer process, the fluorescent screen can be manufactured in a small facility, and the manufacturing process can be simplified.

In a conventional transfer method, a transfer foil is prepared by laminating a peeling layer, a fluorescent layer, a reflective layer, and an adhesive layer on a transfer film of PET or the like. This transfer film is adhered to a specified position at the inner side of the screen panel by the adhesive layer. Later, the transfer film is peeled off, and the peeling layer is vaporized at high temperature and removed. Through such transfer process, the fluorescent screen is formed at the inner side of the screen panel.

However, the former manufacturing method of fluorescent screen involved the following problems. First, a large manufacturing equipment is needed because the transfer and application are carried out in different processes. Second, the resistance value of the transparent grid layer (ITO film) may vary due to uneven application, and if attempted to apply uniformly to avoid such possibility, when applied thickly, the film may be turbid and not transparent due to effect of humidity, or when applied thinly, the resistance may be high and conduction may not be sufficient. Therefore, for example, when applied thickly, it is necessary to dry immediately after application, and there are various problem in management.

In the latter manufacturing method of fluorescent screen, the transfer foil used in forming the fluorescent screen is usually manufactured so as to form its reflective layer and fluorescent layer sequentially in a same pattern. However, for example, when each layer is formed by screen printing, the reflective layer on the fluorescent layer may sag in the peripheral area to spread wider than the fluorescent layer. By using such transfer foil, when the fluorescent screen is formed at the inner side of the panel of the cathode-ray tube, since the reflective layer spreads wider than the fluorescent layer, when the image is displayed, the periphery of the reflective layer may reflect significantly, or the color of the reflective layer may appear like a frame, and the display quality of the cathode-ray tube may be extremely lowered. Still more, it is necessary to manage the manufacturing process of the transfer foil, and the working efficiency is lowered.

To manufacture the reflective layer, by using a transfer foil formed by screen printing of aluminum paste composed of aluminum particles and binder, when the fluorescent screen is formed by transfer method, only a reflective layer poor in reflection efficiency is obtained. When using transfer foil forming the reflective layer by an aluminum vapor deposition film, although it is excellent in reflection efficiency, when the adhesive layer is vaporized in the heat treatment process after transfer, the gas is shielded by the aluminum vapor deposition film and cannot escape, and hence the aluminum vapor deposition film may be swollen and ruptured.

Although various improvements have given to the conventional transfer method, the transfer apparatus is unchanged, and only the white stamp is used. That is, the conventional transfer apparatus comprises a table on which a screen panel is mounted as the work, means for supplying a roll of transfer foil, and an elastic rubber for applying heat and pressure to press the transfer foil onto the screen panel. The transfer foil is supplied to the screen panel placed on the table, and is pressed by the elastic rubber, and thereby the transfer foil is transferred.

However, since the screen panel is made of glass, the pressure may be applied unevenly when transferring, the screen panel may be broken, or the transfer foil may be creased, and it has been difficult to transform uniformly.

SUMMARY OF THE INVENTION

In the light of the above problems, the invention presents a transfer method and a transfer apparatus capable of transferring uniformly even on an object of transfer having a three-dimensional curvature.

The invention also presents a flat cathode-ray tube and its manufacturing method capable of keeping uniformity of film properties of the fluorescent screen, enhancing the display quality, and shortening the manufacturing process of fluorescent screen by batch transfer.

The invention further presents a flat cathode-ray tube and its manufacturing method excellent in reflection efficiency of reflective layer on the fluorescent screen, easy to manufacture, and excellent in visual recognition of display image, that is, display quality.

The invention yet further presents a transfer foil preferably applied in manufacture of flat cathode-ray tube, in particular, fabrication of its fluorescent screen.

The transfer foil of the invention is formed by laminating and forming at least a fluorescent layer, a reflective layer, and a grid layer on a transfer substrate.

The reflective layer is preferably formed at the inner side of the circumference of the fluorescent layer.

In the transfer foil of the invention, since at least the fluorescent layer, reflective layer, and grid layer are laminated and formed on the transfer substrate, the fluorescent screen can be formed by batch transfer, and uniformity of film properties of the fluorescent screen can be assured.

When the reflective layer is formed at the inner side of the circumference of the fluorescent layer, the reflective layer does not project outside of the fluorescent layer if transferred on the panel. When sequentially printing and forming each layer on the transfer substrate, the reflective layer does not sag and spread widely from the periphery of the fluorescent layer.

The transfer foil of the invention is composed by laminating and forming at least a fluorescent layer and an electrically conductive reflective layer on a transfer substrate.

The reflective layer is preferably formed at the inner side of the circumference of the fluorescent layer.

In the transfer foil of the invention, since at least the fluorescent layer and the electrically conductive reflective layer are laminated and formed on the transfer substrate, the fluorescent screen can be formed by batch transfer, and uniformity of film properties of the fluorescent screen can be assured.

In addition, since the reflective layer serves also as the grid layer, the grid layer can be omitted, and the film structure of the transfer foil can be simplified.

When the reflective layer is formed at the inner side of the circumference of the fluorescent layer, the reflective layer does not project outside of the fluorescent layer if transferred on the panel. When sequentially printing and forming each layer on the transfer substrate, the reflective layer does not sag and spread widely from the periphery of the fluorescent layer.

The transfer method of the invention is characterized by transferring a transfer layer from a transfer foil on an object of transfer while controlling the transfer pressure of a heat transfer roller.

In the transfer method of the invention, since the transfer layer from the transfer foil is transferred on the object of transfer while controlling the transfer pressure of the heat transfer roller, uniform transfer is possible.

The transfer apparatus of the invention comprises at least a heat transfer roller, and pressing means having a control function for controlling the transfer pressure of the heat transfer roller.

In the transfer apparatus of the invention, since it comprises the heat transfer roller, and pressing means having a control function for controlling its transfer pressure, the transfer pressure is controlled depending on the shape of the object of transfer. Therefore, for example, on the object of transfer having a curvature, the transfer layer from the transfer foil can be transferred at a constant transfer pressure.

The flat cathode-ray tube of the invention is composed by laminating and forming a grid layer, a reflective layer, and a fluorescent layer by transfer from a transfer foil at the inner side of a panel.

The reflective layer is preferably formed at the inner side of the circumference of the fluorescent layer.

In the flat cathode-ray tube of the invention, since the fluorescent screen is formed by the grid layer, reflective layer, and fluorescent layer by transfer from the transfer foil, uniformity of film properties of each layer is assured, and the display quality of image is improved.

When the reflective layer for composing the fluorescent screen is formed at the inner side of the circumference of the fluorescent layer, the reflective layer does not project to show an undesired frame around the image, and the image display is not impaired, and the display quality is stable.

The flat cathode-ray tube of the invention is composed by laminating and forming an electrically conductive reflective layer and a fluorescent layer by transfer from a transfer foil at the inner side of a panel.

The reflective layer is preferably formed at the inner side of the circumference of the fluorescent layer.

In the flat cathode-ray tube of the invention, since the fluorescent screen is formed by the electrically conductive reflective layer and fluorescent layer by transfer from a transfer foil, uniformity of film properties of each layer is assured, and the display quality of image is improved.

In addition, since the reflective layer serves also as the grid layer, the grid layer can be omitted, and the film structure of the fluorescent screen can be simplified.

When the reflective layer for composing the fluorescent screen is formed at the inner side of the circumference of the fluorescent layer, the reflective layer does not project to show an undesired frame around the image, and the image display is not impaired, and the display quality is stable.

The manufacturing method of flat cathode-ray tube of the invention comprises the steps of preparing a transfer foil having at least a fluorescent layer, a reflective layer, and a grid layer laminated and formed on a transfer substrate, and transferring a fluorescent screen composed of fluorescent layer, reflective layer and grid layer by heating, pressing and adhering the grid layer side of the transfer foil to the inner side of the panel, and peeling the transfer substrate.

The reflective layer of the transfer foil is preferably formed at the inner side of the circumference of the fluorescent layer.

According to the manufacturing method of flat cathode-ray tube of the invention, since the fluorescent screen is fabricated at the inner side of the panel by the transfer method by using the transfer foil prepared by laminating at least the fluorescent layer, reflective layer, and grid layer on the transfer substrate, the manufacturing process of the fluorescent screen can be shortened, and the films of each layer for composing the fluorescent screen are uniform in properties and can be manufactured by batch transfer.

By using the transfer foil laminating the fluorescent layer, reflective layer and grid layer, and having the reflective layer formed at the inner side of the circumference of the fluorescent layer, the reflective layer is not formed wider than the fluorescent layer, and the image display is not impaired, so that the flat cathode-ray tube stable in display quality can be manufactured.

The manufacturing method of flat cathode-ray tube of the invention comprises the steps of preparing a transfer foil having at least a fluorescent layer and an electrically conductive reflective layer laminated on a transfer substrate, and transferring a fluorescent screen composed of fluorescent layer and reflective layer by heating, pressing and adhering the reflective layer side of the transfer foil to the inner side of the panel, and peeling the transfer substrate.

The reflective layer of the transfer foil is preferably formed at the inner side of the circumference of the fluorescent layer.

According to the manufacturing method of flat cathode-ray tube of the invention, since the fluorescent screen is fabricated at the inner side of the panel by the transfer method by using the transfer foil prepared by laminating at least the fluorescent layer and electrically conductive reflective layer on the transfer substrate, the manufacturing process of the fluorescent screen can be shortened, and the films of each layer for composing the fluorescent screen are uniform in properties and can be manufactured by batch transfer.

By using the transfer foil laminating the fluorescent layer and reflective layer, and having the reflective layer formed at the inner side of the circumference of the fluorescent layer, the reflective layer is not formed wider than the fluorescent layer, and the image display is not impaired, so that the flat cathode-ray tube stable in display quality can be manufactured.

In addition, since the reflective layer serves also as the grid layer, the grid layer can be omitted, and the film structure of the transfer foil is simplified, so that the film structure of the fluorescent screen can be simplified.

DESCRIPTION OF THE PREFERRED EMBODIMENTS

Figure 1:
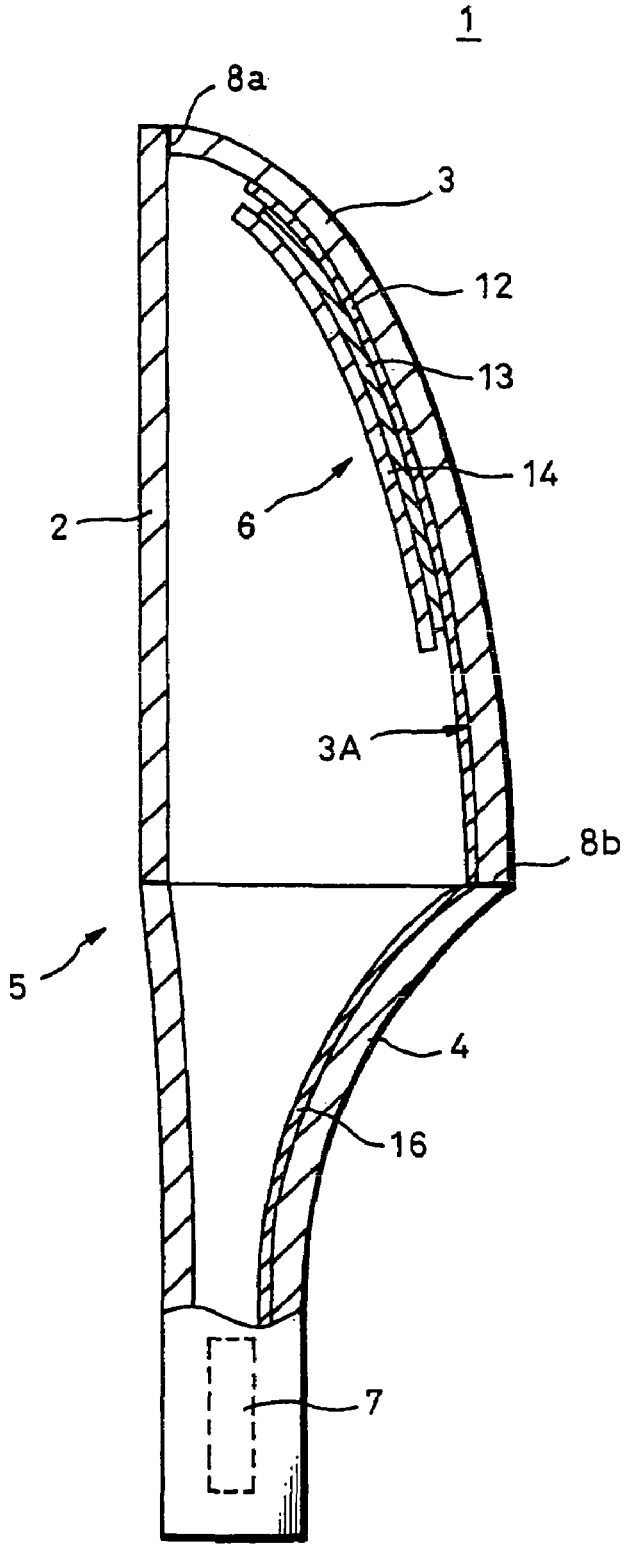
FIG. 1 is a structural diagram showing an embodiment of reflection type flat screen cathode-ray tube of the invention.

Referring now to the drawings, preferred embodiments of the invention are described in detail below.

Figure 2C:
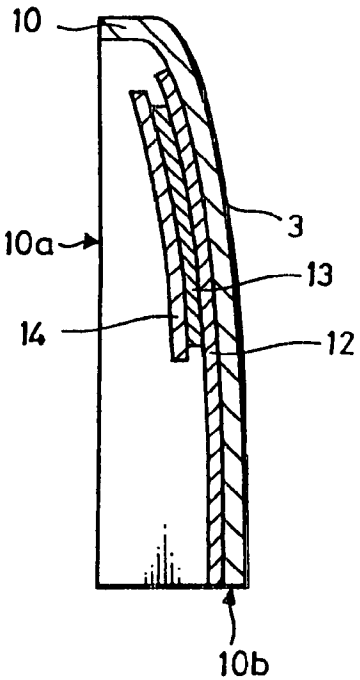
FIG. 2C is a right side view of the screen panel of the flat cathode-ray tube in FIG. 1.
Figure 2A:
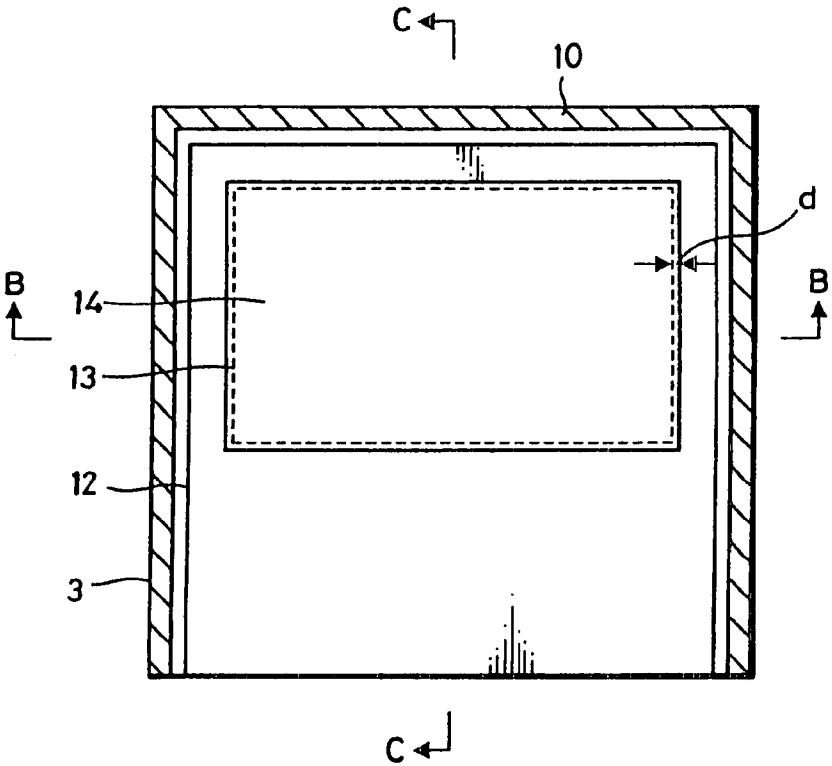
FIG. 2A is a front view of a screen panel of the flat cathode-ray tube in FIG. 1.
Figure 2B:
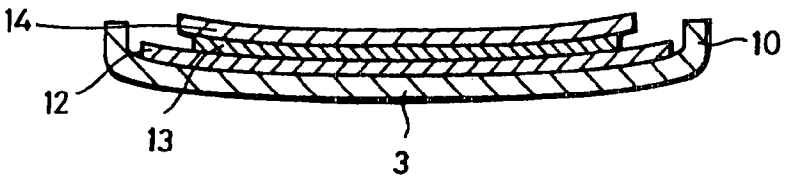
FIG. 2B is a bottom view of the screen panel of the flat cathode-ray tube in FIG. 1.

FIG. 1 and FIG. 2 show an embodiment of a flat cathode-ray tube of the invention. FIG. 1 is a structural diagram of a partial section, and FIG. 2 is a structural diagram of one panel seen by removing its front panel, or a screen panel in this example.

A flat cathode-ray tube 1 of the embodiment comprises a glass tube body 5 having a first panel, or a front panel 2 in this example, a second panel forming a fluorescent screen, or a screen panel 3 in the example, and a funnel 4 bonded together at fist glass junctions 8*a*, 8*b*, and an electron gun 7 sealed in the neck of the funnel 4. A deflection yoke, not shown, for deflecting the electron beam emitted from the electron gun 7 is disposed at the outside of the funnel 4.

The screen panel 3 is formed at a specified curvature in its inner side as shown in FIG. 2, and a riser, or so-called skirt 10 is formed at the edges in three directions. The top 10*a* of the skirt 10 of the screen panel 3 is bonded to the front panel 2 at the fist glass junction 8*a* in FIG. 1, and the bottom 10*b* of the screen panel is bonded to the funnel 4 at the fist glass junction 8*b* in FIG. 1.

A fluorescent screen 6 is adhered and formed on the curved inner side 3A of the screen panel 3. That is, a grid layer (for example, transparent electrically conductive film) 12 is formed on the skirt 10 of the inner side 3A of the screen panel 3 and on the area excluding the so-called blend R portion 11 from the skirt 10 to the inner side, and a fluorescent layer 14 is formed in the region corresponding to the effective screen thereon through a reflective layer 13, thereby forming the fluorescent screen 6.

At the inner side of the funnel 4, an inner electrically conductive film, such as an electrically conductive film 16 of carbon film is applied and formed, and this electrically conductive film 16 is electrically connected with a voltage application terminal (not shown) for applying a voltage to the grid layer 12 at the inner side of the screen panel 3.

In the embodiment, in particular, the reflective layer 13 is formed at the inner side of the circumference of the fluorescent layer 14. That is, the area of the reflective layer 13 is formed smaller than the area of the fluorescent layer 14 to such an extent that lowering of light emission luminance may not be obvious in the peripheral area of the fluorescent screen and that the visual recognition as the fluorescent screen may not deteriorate. The difference (d) of peripheral edge of the reflective layer 13 and peripheral edge of the fluorescent layer 14 may be 0.5 mm or less when seen at one side, and the sum is 1.0 mm or less when seen at both vertical and lateral sides.

The reflective layer 13 may be formed of a white inorganic layer, such as titanium oxide ($TiO_2$), aluminum oxide ($Al_2O_3$), tin oxide ($SnO_x$), zinc sulfide (ZnS), barium sulfate ($BaSO_4$), calcium carbonate ($CaCO_3$), and magnesium oxide (MgO). The reflective layer 13 may be also made of metal film such as aluminum (Al).

In this embodiment, the reflective film 13 is a titanium oxide layer which is a white inorganic matter, and the titanium oxide layer 13 is formed at the inner side of the circumference of the fluorescent layer 14.

In this flat cathode-ray tube 1, a positive voltage (so-called anode voltage) of 5 to 10 kV is applied to the grid layer 12 through the voltage application terminal and electrically conductive film 16. The electron beam generated from the electron gun 7 is accelerated toward the grid layer 12, and is emitted to the fluorescent layer 14. As a result, the fluorescent layer 14 is illuminated, and part of emission light passes through and is reflected by the reflective film 13, and is reproduced through the front panel 2 as video information.

The resistance value of the grid 12 is preferably as small as possible in order to prevent starting failure and charge-up, and it is possible to form at 300 MΩ or less.

According to the flat cathode-ray tube 1 of the embodiment, by using a white inorganic layer, or a titanium oxide layer in this example, as the reflective layer 13, and forming this titanium oxide layer 13 at the inner side of the circumference of the fluorescent layer 14, the visual recognition of the display image, that is, the display quality is enhanced.

Incidentally, when forming the fluorescent screen 6 by the transfer method described below, a transfer foil is prepared by forming transfer layers on the transfer film, that is, peeling layer, fluorescent layer, reflective layer (for example, white inorganic layer), grid layer, and adhesive layer sequentially by screen printing, and at this time when a reflective layer is screen printed in a same area on the fluorescent layer, application sag occurs in the peripheral area. As a result, when transferred on the inner side of the screen panel, the reflective layer is formed wider than the fluorescent layer, and the periphery of the reflective layer appears to be a white frame when video information is reproduced, and the contrast and image visual recognition, that is, display quality deteriorate significantly. This point is improved in the embodiment.

Or when an aluminum film is used as the reflective layer, if the aluminum film slightly projects from the fluorescent layer, the reflected light is obvious in the periphery of the video information, and the contrast and display quality deteriorate similarly. This point is improved in the embodiment.

When forming the fluorescent screen 6 at the inner side of the screen panel 3 by laminating the grid layer 12, reflective layer 13, and fluorescent layer 14 by transfer from the transfer foil, the uniformity of film properties of the layers 12, 13, 14 is assured, and the display quality of image can be enhanced.

The manufacturing method of the reflection type flat cathode-ray tube, in particular, the fabrication method of its fluorescent screen 6 is explained below while referring to FIG. 4 and FIGS. 5A to 5D.

Figure 4A:
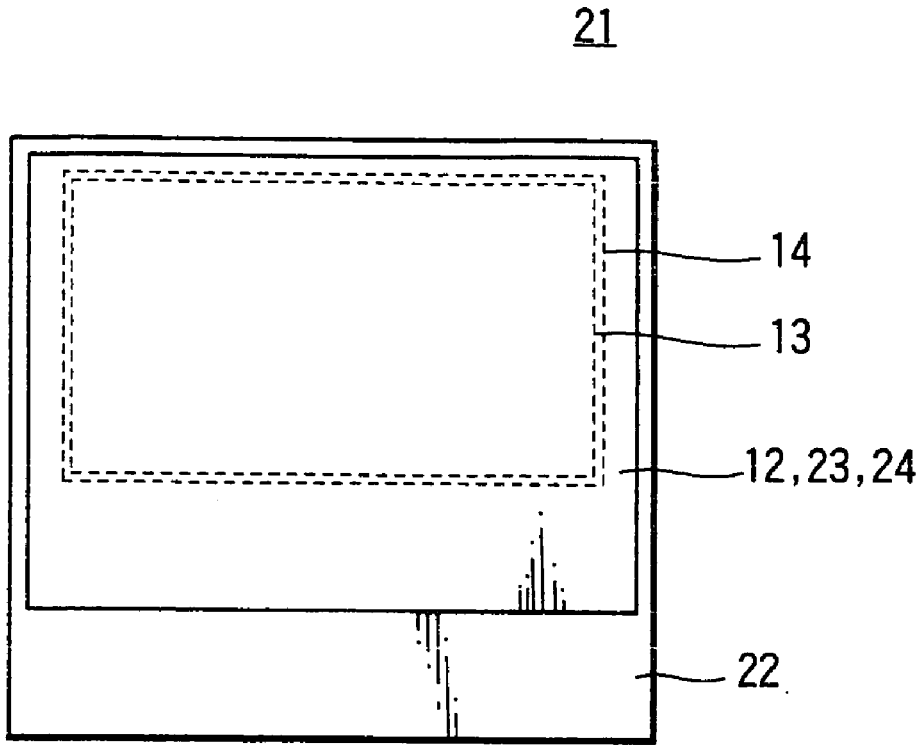
FIG. 4A is a front view showing an embodiment of transfer foil of sheet type according to the invention.
Figure 4B:
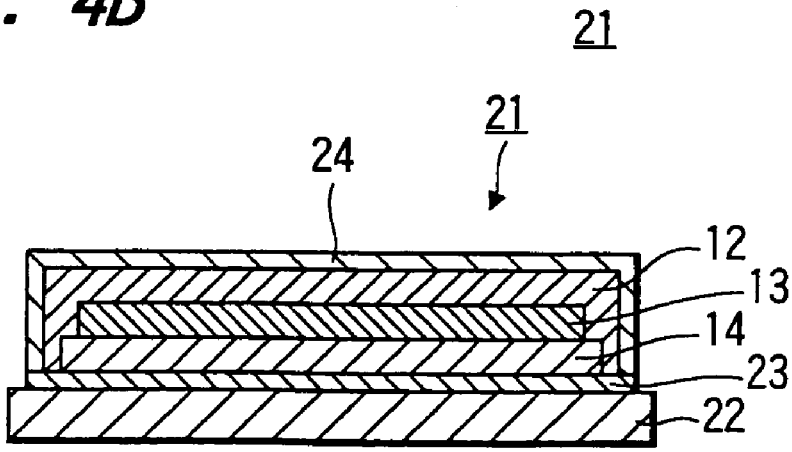
FIG. 4B is a sectional view of the transfer foil.

First, a transfer foil 21 shown in FIGS. 4A, 4B is prepared. This transfer foil 21 is formed on a transfer substrate, for example, a transfer film 22, by sequentially forming a peeling layer 23, a fluorescent layer 14, a reflective layer or titanium oxide layer ($TiO_2$ layer) 13 in the example, a grid layer or transparent ITO grid layer 12 in the embodiment, and an adhesive layer 24 by printing (for example, screen printing or gravure printing).

That is, on the transfer film 22, the peeling layer 23 having a function of peeling at specified temperature (for example, about 200° C.) and vaporizing at higher temperature (for example, about 300° C.) than the peeling temperature is formed. As the transfer film 22, a resin film of about 25 to 100 μm in thickness is used, or, in this example, a PET (polyethylene terephthalate) film of about 75 μm. The peeling layer 23 is made of, for example, an acrylic resin, which is formed in a thickness of about 6 to 10 μm.

On the peeling layer 23, a fluorescent layer 14 of same area as effective screen is formed, for example, by screen printing. The fluorescent layer 14 is formed of fine particles (for example, mean particle size of 4.5 μm or less) of, for example, $Y_2O_2S$ (yttrium oxide sulfide) or $Y_2O_2S$:Tb (yttrium oxide sulfide: terbium added), in a thickness of about 20 to 30 μm.

On the fluorescent layer 14, a white inorganic layer, or a titanium oxide layer 13 in this example is formed as a reflective layer, in a thickness of about 10 to 15 μm. At this time, the titanium oxide layer 13 is formed at the inner side of the circumference of the fluorescent layer 14, therefore, in a slightly smaller area than the area of the fluorescent layer 14. The titanium oxide layer 13 is formed by printing, by using a paint (so-called paste) composed of titanium oxide particles and binder. Herein, the titanium oxide layer 13 must be printed so as to be free from blur or blot on the surface of the fluorescent layer 14 of a large particle size of fluorescent material.

Particles of $TiO_2$ are smaller than fluorescent particles, and the viscosity of paint of titanium oxide is relatively low, and therefore if the titanium oxide layer 13 is printed on the surface of the fluorescent layer 14 in the same area as the fluorescent layer 14, it sags and comes out from the circumference of the fluorescent layer 14, possibly spreading widely. When the titanium oxide layer 13 spreads wider than the fluorescent layer 14, as mentioned above, the periphery of the titanium oxide layer 13 appears to be a white frame, and the display quality of the flat cathode-ray tube is lowered. Accordingly, the titanium oxide layer 13 is printed in a smaller area than the area of the fluorescent layer 14 to such an extent as not to sag in the periphery.

To avoid blur or blot, moreover, the titanium oxide layer 13 is printed in a specified film thickness, and for this purpose, therefore, the viscosity of the paint of the titanium oxide layer 13 is preferred to be about 10 to 80 Pa·S. The binder used in this paint of titanium oxide is preferred to be, for example, an acrylic resin containing ethyl cellulose.

On the titanium oxide layer 13, a grid layer for applying an anode voltage is formed, and in this example, an ITO grid layer 12 is formed as a transparent electrically conductive film. The ITO grid layer 12 is formed in an area corresponding to the entire surface excluding the skirt 10 at the inner side of the screen panel and the blend R portion 11. An adhesive layer 24 is formed on the ITO grid layer 12. The adhesive layer 24 is an adhesive layer having a function of vaporizing at a higher temperature than the vaporizing temperature of the peeling layer 23, and it is made of, for example, butyral resin or polyamide resin, and formed in a thickness of about 6 to 10 μm. The butyral resin and polyamide resin vaporize at temperature of about 400 to 485° C.

Screen printing is employed, for example, in formation of peeling layer 23, fluorescent layer 14, titanium oxide layer 13 of reflective layer, ITO grid layer 12 of grid layer, and adhesive layer 24 on the transfer film 22. After forming layers by screen printing, the layers are dried in air or by machine, and the film thickness of each layer is stabilized. This drying process may be done in each layer. That is, after screen printing and drying of one layer, next layer is screen printed, and this process is repeated to prepare the transfer foil. Thus, the transfer foil 21 is fabricated.

When forming the fluorescent screen 6 at the inner side of the screen panel 3, this transfer foil 21 is prepared.

Figure 5A:
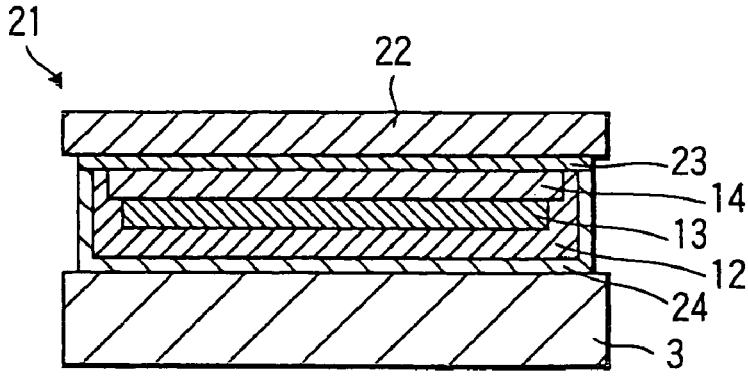
FIG. 5A to 5D are manufacturing process charts showing a manufacturing method of fluorescent screen according to the invention by using the transfer foil in FIG. 4.

First, as shown in FIG. 5A, the transfer foil 21 is held at the inner side 3A of the screen panel 3 by way of the adhesive layer 24.

Figure 5B:
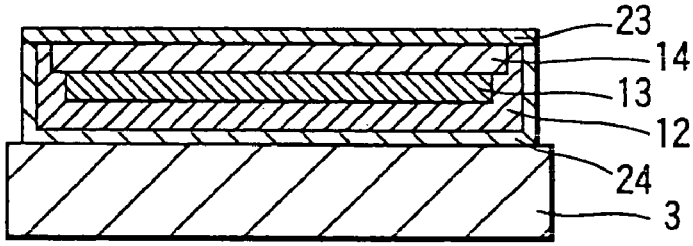

Next, the screen panel 3 is heated to a peeling temperature of the transfer film 22 (for example, about 200° C.). As a result, as shown in FIG. 5B, the ITO grid layer 12, titanium oxide layer 13, and fluorescent layer 14 are adhered to the screen panel 3 through the adhesive layer 24, and the transfer film 22 on the peeling layer 23 is peeled and removed.

If, meanwhile, transferring the transfer foil by using a transfer device described below, it can be transferred through a heat transfer roller heated to a specified temperature (200 to 250° C.) at the transfer device side without heating the screen panel 3.

Figure 5C:
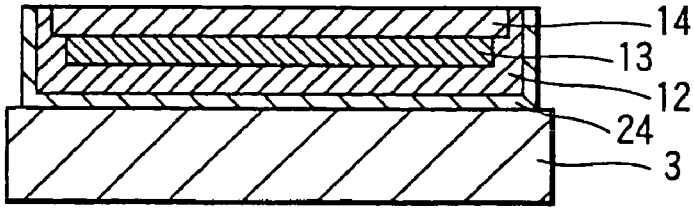

After the transfer film 22 is removed, the screen panel 3 is heated to a higher temperature (for example, about 300° C.) than the peeling temperature of the transfer film 22. As a result, as shown in FIG. 5C, the peeling layer 23 is vaporized, and exhausted and removed from the screen panel 3.

Figure 5D:
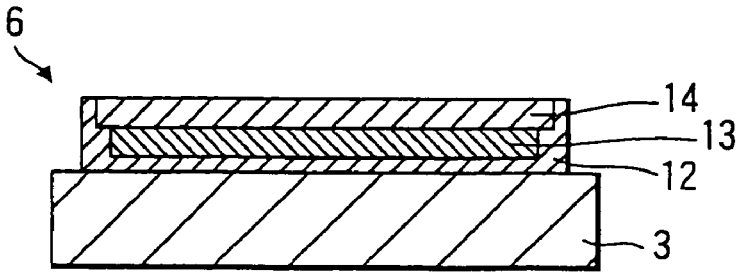

After removing the peeling layer 23, the screen panel 3 is further heated to a higher temperature (for example, about 400 to 485° C.) than the vaporizing temperature of the peeling layer 23. As a result, as shown in FIG. 5D, the adhesive layer 24 is vaporized, and exhausted and removed by way of the ITO grid layer 12, titanium oxide layer 13, and fluorescent layer 14. In this manner, the grid layer 12 and reflective layer 13 are formed at the inner side of the circumference of the fluorescent layer 14, at the inner side 3A of the screen panel 3 by the heat transfer method, and the fluorescent screen 6 is completed.

Herein, it is also a feature of the embodiment that the white inorganic layer as the reflective layer 13 can be also formed on the screen panel 3 by the transfer method.

Hitherto, as the forming method of white inorganic layer, for example, titanium oxide layer, the slurry method has been known (see Japanese Laid-open Patent No. 11-96948), but it has not been attempted to form by the transfer method. The reason is that the optimum condition necessary for screen printing of titanium oxide layer has not been found yet.

In the invention, by selecting the viscosity of the titanium oxide paint (paste) at 10 to 80 Pa·S, using an acrylic resin containing ethyl cellulose as binder, and optimizing the mesh material and mesh size of the screen plate suited to this viscosity, the optimum condition for screen printing is found out, and the difficulty in transfer has been overcome. For example, by setting the mesh size smaller than in the prior art, a titanium oxide layer can be formed on the fluorescent layer of a larger particle size.

According to the manufacturing method of the flat cathode-ray tube of the embodiment, since the fluorescent screen 6 is fabricated by the transfer method on the transfer film 22, by using the transfer foil 21 prepared by forming, for example, the peeling layer 23, fluorescent layer 14, titanium oxide layer as reflective layer of a slightly smaller area than the fluorescent layer 23, ITO grid layer 12 as grid layer, and adhesive layer 24 sequentially by screen printing, on the fluorescent screen 6 of the reflection type flat cathode-ray tube, the periphery of the fluorescent layer 14 after baking is formed larger than the reflective layer of titanium oxide layer 13, and the quality of forming process of the titanium oxide layer 13 is stabilized. At the same time, the titanium oxide layer 13 does not spread over to appear as white frame, and the flat cathode-ray tube of advanced display quality is manufactured. In addition, the titanium oxide layer 13 is large in the reflectivity, and by using this titanium oxide layer 13 as the reflective layer, the flat cathode-ray tube of high reflection efficiency and high brightness can be easily manufactured.

Since the transfer foil 21 formed by laminating the fluorescent layer 14, reflective layer 13 and grid layer 12 is used, the fluorescent screen can be formed at the inner side of the screen panel 3 by batch transfer. Moreover, the film properties of the layers 12, 13, 14 are uniform, and the flat cathode-ray tube having a fluorescent screen of stable quality can be easily manufactured.

Figure 6A:
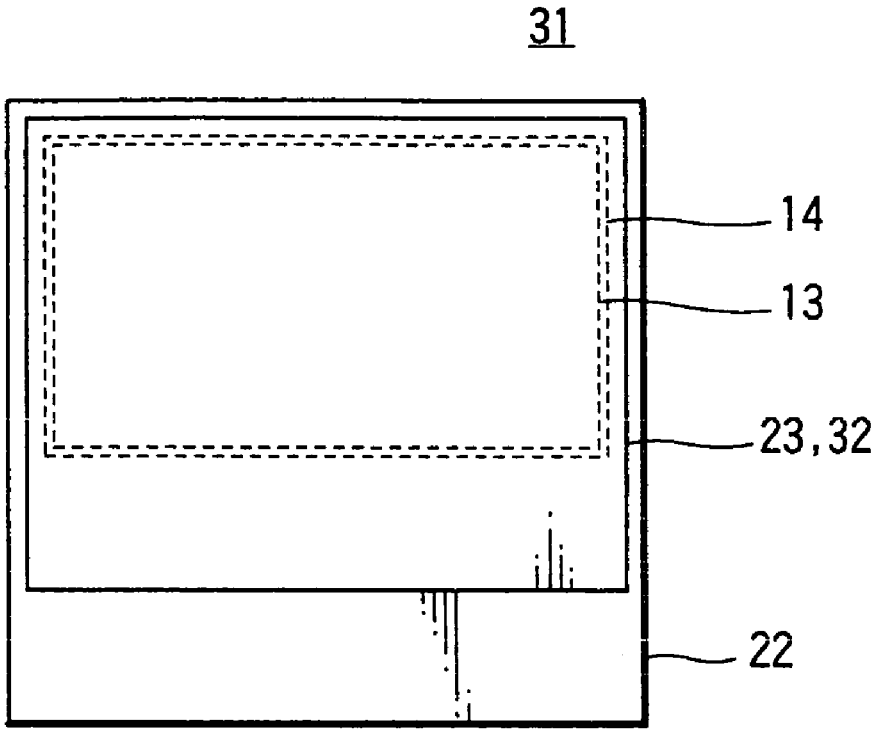
FIG. 6A is a front view showing other embodiment of transfer foil of sheet type according to the invention.
Figure 6B:
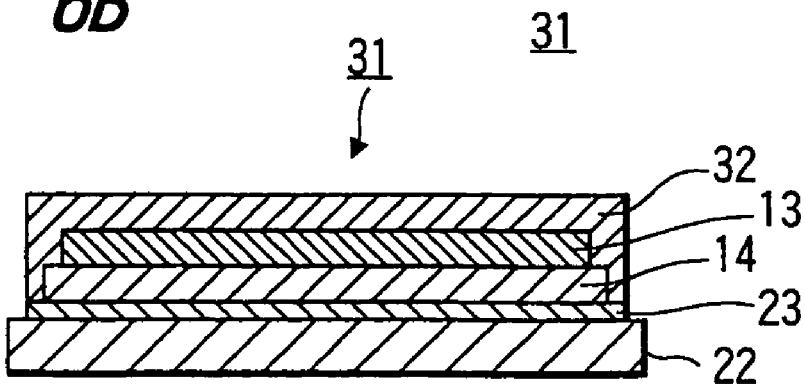
FIG. 6B is a sectional view of the transfer foil.

FIGS. 6A and 6B show another embodiment of the transfer foil of the invention.

A transfer foil 31 of the embodiment is formed on a transfer film 22, by sequentially forming a peeling layer 23, a fluorescent layer 14, a reflective layer or titanium oxide layer ($TiO_2$ layer) 13 in the example, and a grid layer 32 made of a mixed material containing grid component and adhesive component by printing (for example, screen printing or gravure printing). Herein, the transfer film 22, peeling layer 23, fluorescent layer 14, and reflective layer 13 are same as used in the foregoing transfer foil 21, and detailed description is omitted.

That is, on the transfer film 22, same as mentioned above, the peeling layer 23 having a function of peeling at specified temperature (for example, about 200° C.) and vaporizing at higher temperature (for example, about 300° C.) than the peeling temperature is formed. On the peeling layer 23, a fluorescent layer 14 of same area as effective screen is formed. On the fluorescent layer 14, a titanium oxide layer 13 is formed as a reflective layer. At this time, the titanium oxide layer 13 is formed at the inner side of the circumference of the fluorescent layer 14, therefore, in a slightly smaller area than the area of the fluorescent layer 14.

To cover the fluorescent layer 14 and titanium oxide layer 13, a grid layer 32 for applying an anode voltage is formed in a thickness of about 3 to 30 μm. The grid layer 32 is formed on the nearly entire surface of the inner side of the screen pane 3. The grid layer 32 is formed of a mixture of grid material and adhesive material, and has the functions of both grid and adhesive layer in the process before transfer. The grid component is fine particles of ITO or the like (for example, mean particle size of 1 μm or less), and is transparent, and its resistance value after baking is 300 MΩ or less. Depending on the application of the cathode-ray tube, as the grid component, a material becoming black or gray after baking such as carbon or chromium oxide, with resistance value after baking of 100 MΩ or less may be used.

On the other hand, the adhesive component vaporizes at a higher temperature than the vaporizing temperature of the peeling layer 23 (for example about 300° C.), and is of same category as the grid component slurry. It must be prepared so as not to separate in consideration of the affinity of the grid material and adhesive resin. Specifically, when the grid material is ITO, butyral resin or polyamide resin vaporizing at temperature of about 400 to 485° C. may be used. For example, when the grid solvent is an acrylic resin, the adhesive component is also an acrylic component, and after the binder contained in the binder is vaporized, the grid layer 32 becomes a grid layer containing only a transparent grid material.

The ratio of the grid component and adhesive component in the grid layer 32 is preferably 20 to 80% of grid component, preferably in a range of 40 to 60%. If less than 20%, the function as the grid layer is not exhibited sufficiently, or if more than 80%, the adhesive layer to the screen panel 3 is not expressed sufficiently when transferring.

Screen printing is employed, for example, in formation of peeling layer 23, fluorescent layer 14, titanium oxide layer 13 of reflective layer, and grid layer 32 on the transfer film 22. After forming layers by screen printing, the layers are dried in air or by machine, and the film thickness of each layer is stabilized. Thus, the transfer foil 31 is fabricated.

Referring next to FIG. 7, the manufacturing method of fluorescent screen 6 using the transfer foil 31 is explained.

Figure 7A:
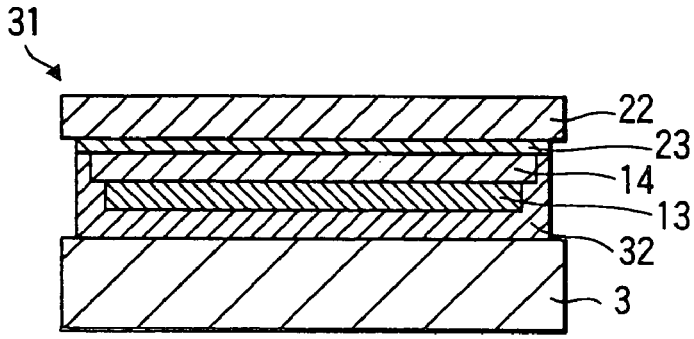
FIG. 7A to 7D are manufacturing process charts showing a manufacturing method of fluorescent screen according to the invention by using the transfer foil in FIG. 6.
Figure 7B:
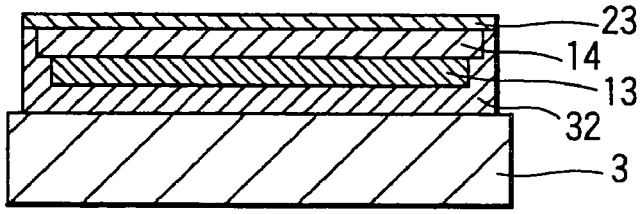

First, as shown in FIG. 7A, the transfer foil 31 is held at the inner side of the screen panel 3 by making use of the adhesive function of the grid layer 32 formed on the transfer film 22. Next, the screen panel 3 is heated to a peeling temperature of the transfer film 22 (for example, about 200° C.). As a result, as shown in FIG. 7B, the grid layer 32, reflective layer 13, and fluorescent layer 14 are adhered to the screen panel 3, and the transfer film 22 on the peeling layer 23 is peeled and removed.

In this case, same as mentioned above, when transferring the transfer foil by using a transfer device described below, it can be transferred through a heat transfer roller heated to a specified temperature without heating the screen panel 3.

Figure 7C:
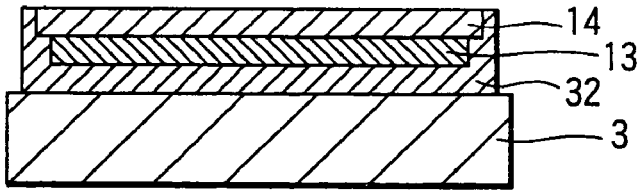
Figure 7D:
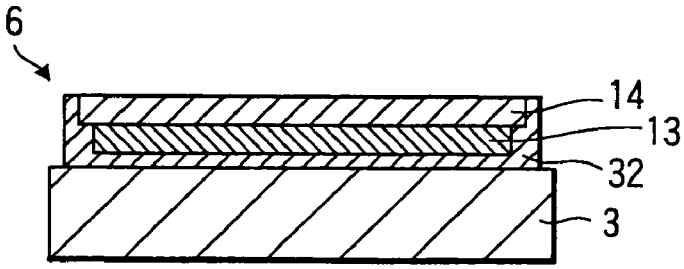

After the transfer film 22 is removed, the screen panel 3 is heated to a higher temperature (for example, about 300° C.) than the peeling temperature of the transfer film 22. As a result, as shown in FIG. 7C, the peeling layer 23 is vaporized, and exhausted and removed from the screen panel 3. After removing the peeling layer 23, the screen panel 3 is further heated to a higher temperature (for example, about 400 to 485° C.) than the vaporizing temperature of the peeling layer 23. As a result, as shown in FIG. 7D, the adhesive component of the grid layer 32 is vaporized, and exhausted and removed through the fine particles of the grid component of the grid layer 32, reflective layer 13, and fluorescent layer 14. After the adhesive component is vaporized, the grid layer 32 becomes a grid layer composed of only a transparent grid material.

In this manner, the grid layer 32 and reflective layer 13 are formed at the inner side of the circumference of the fluorescent layer 14, at the inner side 3A of the screen panel 3 by the heat transfer method, and the fluorescent screen 6 is completed.

According to the manufacturing method of the flat cathode:ray tube of the embodiment, since the fluorescent screen 6 is fabricated by the transfer method on the transfer film 22, by using the transfer foil 21 prepared by forming, for example, the peeling layer 23, fluorescent layer 14, titanium oxide layer as reflective layer of a slightly smaller area than the fluorescent layer 23, ITO grid layer 12 as grid layer, and adhesive layer 24 sequentially by screen printing, on the fluorescent screen 6 of the reflection type flat cathode-ray tube, the periphery of the fluorescent layer 14 after baking is formed larger than the reflective layer of titanium oxide layer 13, and the quality of forming process of the titanium oxide layer 13 is stabilized. At the same time, the titanium oxide layer 13 does not spread over to appear as white frame, and the flat cathode-ray tube of advanced display quality is manufactured. In addition, the titanium oxide layer 13 is large in the reflectivity, and by using this titanium oxide layer 13 as the reflective layer, the flat cathode-ray tube of high reflection efficiency and high brightness can be easily manufactured.

By using a titanium oxide layer 13 as the reflective layer, the flat cathode-ray tube of high reflection efficiency and high brightness can be manufactured.

Moreover, since the grid layer 32 of the transfer foil 31 is formed of a mixed material containing adhesive component, it is not necessary to form the adhesive layer separately on the grid layer 32, and the number of layers formed on the transfer film 22 is decreased. Therefore, the manufacturing process can be simplified, and occurrence of defects is decreased.

Since the transfer foil 31 formed by laminating the fluorescent layer 14, reflective layer 13 and grid layer 32 is used, the fluorescent screen can be formed at the inner side of the screen panel 3 by batch transfer. Moreover, the film properties of the layers 32, 13, 14 are uniform, and the flat cathode-ray tube having a fluorescent screen of stable quality can be easily manufactured.

Figure 8:
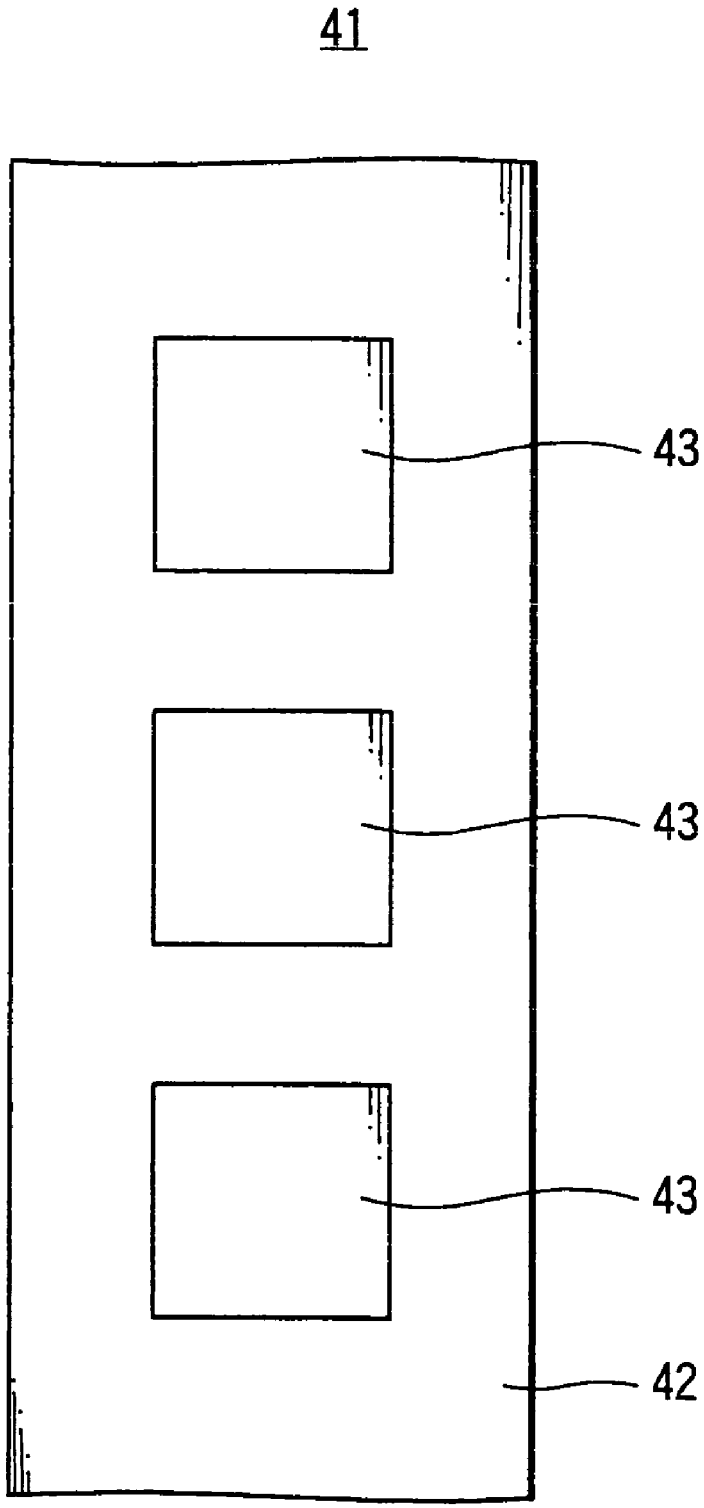
FIG. 8 is a structural diagram showing a different embodiment of transfer foil of roll type according to the invention.

The transfer foils 21, 31 are composed of sheets, but as shown in FIG. 8, a roll type transfer foil 41 may be composed by forming a plurality of transfer foil elements 43 in a layer structure, same as shown in FIG. 4 or FIG. 6, at specific intervals on a long transfer film 42, for example, a layer structure composed of peeling layer 23, fluorescent layer 14, reflective layer 13, grid layer 12, and adhesive layer 24, or a layer structure composed of peeling layer 23, fluorescent layer 14, reflective layer, and grid layer 32. By using this thinner toll type transfer foil 41, continuous heat transfer is realized.

When peeling the transfer film, the transfer film and peeling layer may be peeled off together. In this case, the heat treatment at the screen panel side for removing the peeling layer after transfer can be omitted.

In the transfer foils 21, 31, 41 of the foregoing examples, the peeling layer 23 is formed on the transfer film 22 or 42, and the fluorescent layer 14 is formed on the peeling layer 23, but by using the transfer film having peeling function itself by coating the transfer film with silicone or wax, or printing thermoplastic resin, the peeling layer may be omitted, and the transfer foil may be composed by forming the fluorescent layer 14 directly on the transfer film.

As the reflective layer 13 for composing the transfer foil of the invention, for example, tin oxide may be used, but the tin oxide is expensive, and lower in refractive index as compared with titanium oxide. By contrast, the titanium oxide is inexpensive and has a higher refractive index, and is excellent in reflection efficiency as the reflective layer, so that the screen may be more heightened in brightness.

In FIG. 1, the reflection type flat cathode-ray tube 1 is composed by forming the reflection type fluorescent screen 6 by transfer from the transfer foil at the inner side 3A of the screen panel, that is, by forming the grid layer 12, reflective layer 13, and fluorescent layer 14, but, although not shown in the diagram, a transmission type flat cathode-ray may be composed by forming a transmission type fluorescent screen by transfer from the transfer foil at the inner side 3A of the screen panel, that is, by forming the grid layer, fluorescent layer and reflective layer in this order, and forming the reflective layer at the inner side of the circumference of the fluorescent layer. Also not shown, a transmission type flat cathode-ray tube may be composed by forming a fluorescent screen of a same film structure as the fluorescent screen 6 in FIG. 1 by transfer from transfer foil at the inner side 3A of the screen panel 3, that is, by forming the grid layer 12, reflective layer 13, and fluorescent layer 14, and forming the reflective layer 13 in a proper film thickness so as to pass electron beam and forming the fluorescent layer 14 in a great thickness.

Figure 3:
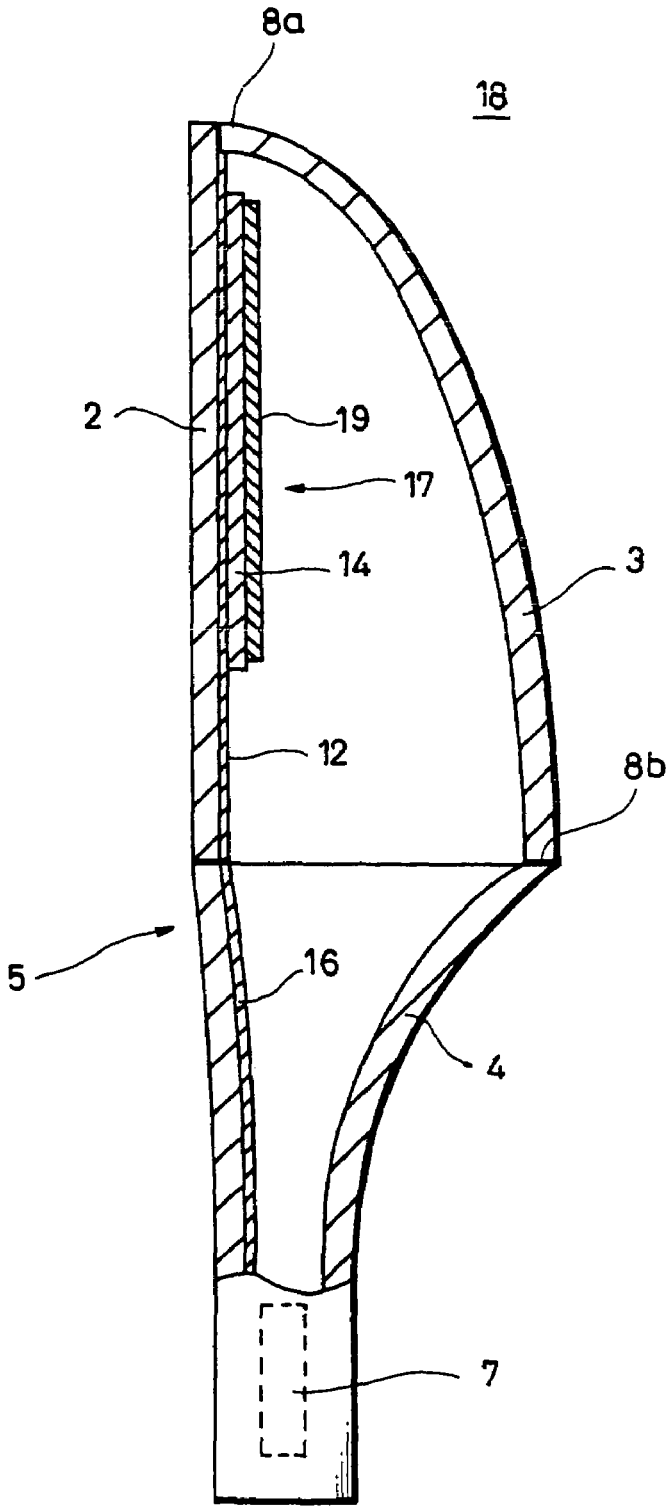
FIG. 3 is a structural diagram showing other embodiment of transmission type flat screen cathode-ray tube of the invention.

Further, as shown in FIG. 3, a fluorescent screen 17 by transfer from transfer foil is formed at the inner side of a front panel 2 which is a first panel, that is, a grid layer 12, a fluorescent layer 14, and a reflective layer (for example, a layer of a same material as the reflective layer 13 in FIG. 1) 19 are formed, and the reflective layer 19 is formed at the inner side of the circumference of the fluorescent layer 14, so that a transmission type flat cathode-ray tube 18 can be composed. In this case, the front panel 2 is the so-called screen panel.

Herein, as the fluorescent screen 6 by transfer method, the grid layer 12, reflective layer 13 of white inorganic layer, fluorescent layer 14 are laminated, but the grid layer 12 may be omitted by using an electrically conductive white inorganic layer so that the reflective layer may also function as grid layer. That is, the fluorescent screen composed of the reflective layer made of electrically conductive white inorganic layer and the fluorescent layer thereon may be formed by batch transfer at the inner side of the screen panel same as in the foregoing examples. In this case, if the white inorganic layer itself is not electrically conductive, it may be mixed with an electrically conductive material such as ITO (indium tin oxide), so that the white inorganic layer may be electrically conductive. Thus, since the white inorganic layer of the reflective layer serves also as the grid layer, the grid layer can be omitted, and the film structure of the fluorescent screen can be simplified.

Referring next to FIG. 9 to FIG. 23, an embodiment of transfer method and transfer apparatus of the invention is explained. This embodiment is suited to the case of transferring the fluorescent screen 6 on the inner side of the screen panel 3.

Figure 9:
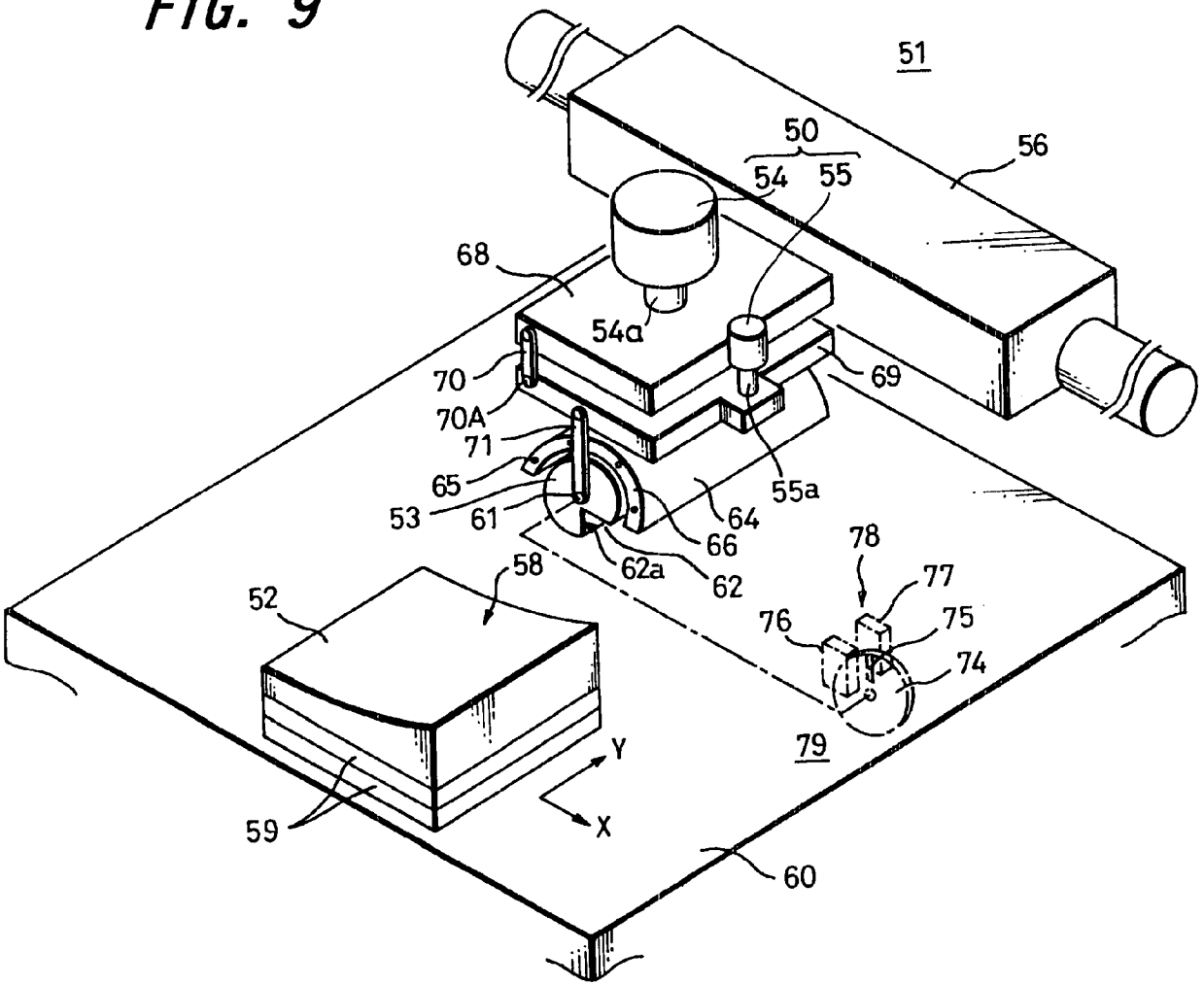
FIG. 9 is a schematic structural view showing an embodiment of a transfer apparatus according to the invention.

FIG. 9 shows a schematic structure of a transfer apparatus 51 of the embodiment which can be applied in transfer of fluorescent screen on the screen panel of the flat cathode-ray tube.

The transfer apparatus 51 comprises a work holder 52 for mounting and fixing the screen panel 3 which is the work to be transferred, a heat transfer roller 53, pressing means 50 for controlling the transfer pressure of the heat transfer roller 53, and moving means 56 for moving the heat transfer roller 53 at a specific speed in the transfer direction. The pressing means 50 is composed of, for example, main pressing means 54 for pressing the heat transfer roller 53 to the inner side of the screen panel 3 through the transfer foil, and pressure control means 55 for controlling the pressing force (the pressing force distribution on the panel inner side) of the main pressing means 54 so that the pressing force may be constant in the embodiment, so as to control the pressing force of the heat transfer roller 53 on the transfer foil. These components are disposed on a support base 60 by way of frame and others.

The work holder 52 sits on the support base 60, and has a platform 58 of the same shape as the outer shape of the screen panel 3, and, although not shown, is designed to fix the screen panel 3 on the platform 58 by sucking in vacuum in a mounted state with the inner side 3A facing upward. That is, plural suction holes are formed in the platform 58, and the screen panel 3 plugs the suction holes so as to suck in vacuum and hold. The work holder 52 is disposed on a so-called XY table 59 designed to be movable in the X-direction and Y-direction within a horizontal plane for the purpose of positioning.

Figure 10:
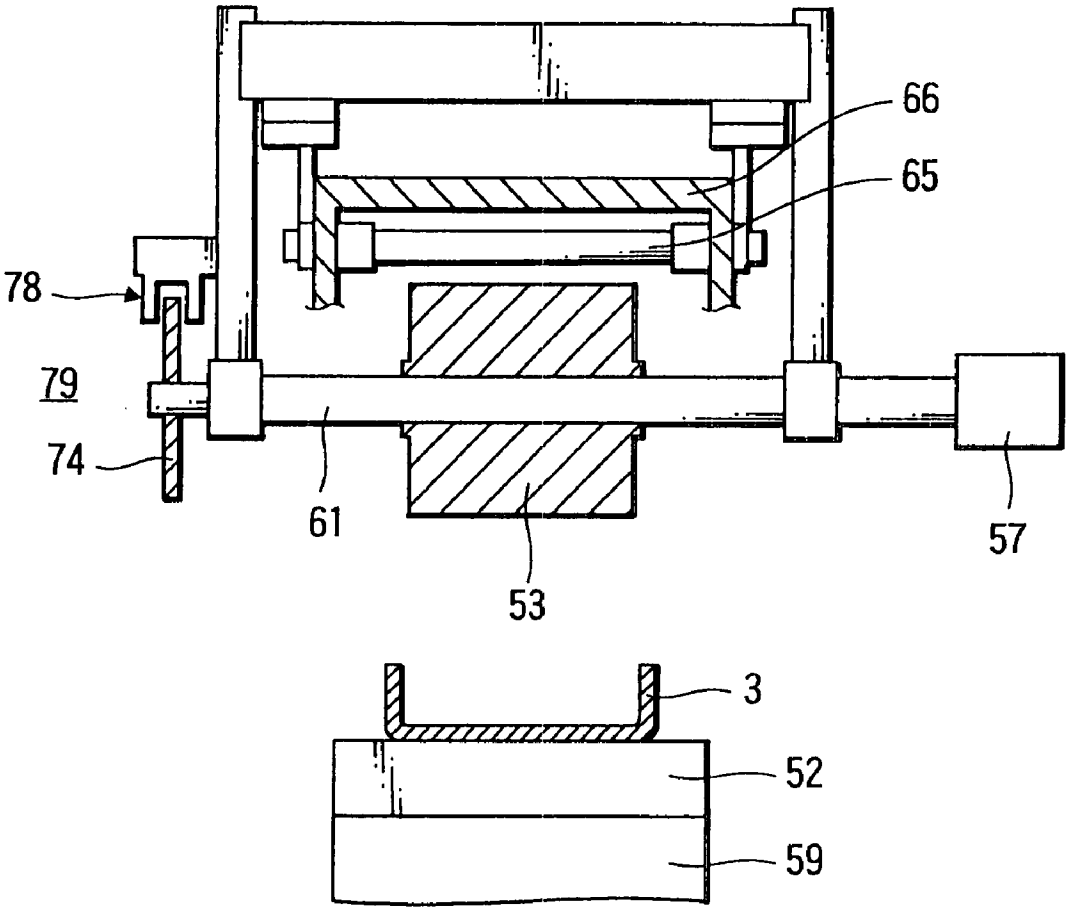
FIG. 10 is a sectional view of essential parts as seen from the front side in FIG. 9.

The heat transfer roller 53 is rotatable about a horizontal drive shaft 61, and is long enough to be inserted in the screen panel 3, that is, it has a length slightly shorter than the width (width in the horizontal direction of the screen) at the inner side of the screen panel 3, and a notch 62 is formed in the overall longitudinal direction in part of the outer surface (see FIG. 9 and FIG. 10). The heat transfer roller 53 is formed of an elastic roller of hardness of 70 to 90°, for example, about 80°, or a silicone roller of heat resistant silicone rubber.

Figure 11A:
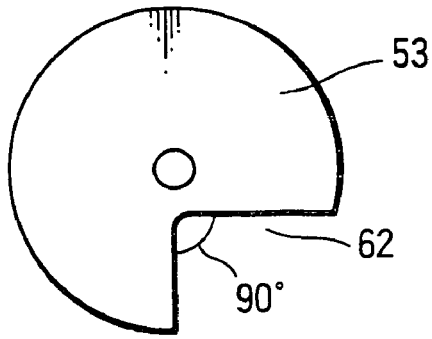
FIG. 11A is a side view showing an embodiment of heat transfer roller of the transfer apparatus.
Figure 11B:
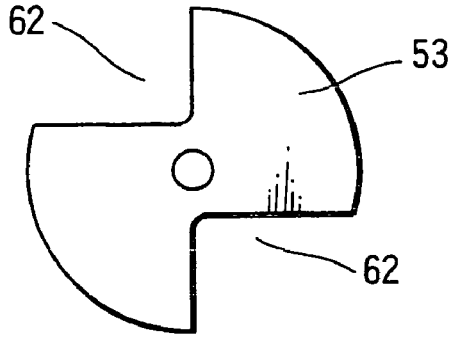
FIG. 11B is a side view showing other embodiment of heat transfer roller of the transfer apparatus.

The notch 62 is opened at, for example, 90° in one position of the outer surface as shown in FIG. 11A, at the face side of the heat transfer roller 53. Or, as shown in FIG. 11B, the notch 62 is formed at plural positions, for example, opened at 90° in two symmetrical positions on the outer surface. The heat transfer roller 53 is designed to move, when transferring the transfer foil, in the inner side direction of the screen panel 3, that is, toward the funnel junction side along the curvature from the skirt 10 side.

In the upper part of the heat transfer roller 53, semicylindrical heating means 64 is fixed and disposed along the roller longitudinal direction (see FIG. 9 and FIG. 10). The heat transfer roller 53 is heated by this heating means 64, and controlled at specified temperature, that is, heat transfer temperature, for example, 200 to 250° C. When heating the heat transfer roller 53, the heat transfer roller 53 is rotated so that the entire roller may be heated to a uniform control temperature. The heating means 64 has plural bar heaters 65 incorporated in a heater cover 66.

On the other hand, a fixed substrate 68 and a movable member 69 coupled to this fixed substrate 68 are disposed. The movable member 69 has the both sides at one end thereof rotatably supported at both sides at one end of the fixed substrate 68 like a cantilever through a coupling member 70, and is coupled to the heat transfer roller 53 through a coupling member 71. The movable member 69 and heat transfer roller 53 are coupled through the coupling member 71 between the intermediate both sides of the movable member 69 and both ends of the drive shaft 61 of the heat transfer roller 53. The coupling member 71 is rotatably provided on the movable member 69 and drive shaft 61 of the heat transfer roller 53.

The main pressing means 54 fixed on a support not shown is composed of, for example, an air cylinder (called main cylinder hereinafter), and the leading end of its cylinder block 54*a* is fixed in the central position of the fixed substrate 68. The pressure control means 55 is composed of, for example, an air bag cylinder (called pressure control cylinder hereinafter), and the end of the cylinder rod 55*a* is attached to other end of the movable member 69. The main cylinder 54 is set at a pressure so as to apply a specific pressure to the screen panel 3 to be transferred. The pressure control cylinder 55 is set at a pressure so as to hold a specific transfer pressure by adjusting the pressure applied to the screen panel 3.

The pressure of the pressure control cylinder 55 is set at a value smaller than the pressure of the main cylinder 54 and larger than the transfer pressure by the heat transfer roller 53. The pressure (transfer pressure) applied to the screen panel 3 is controlled at a specified pressure by the pressure control cylinder 55, for example, constant at 3 kgf/cm$^2$ to 5 kgf/cm$^2$. This transfer pressure is monitored by the pressure gauge not shown.

A detecting device 79 is provided for detecting the rotating position upon start of transfer of the heat transfer roller 53, that is, the rotating position of the notch 62. This detecting device 79 is composed of a detecting plate 74 and a photoelectric sensor 78.

The detecting plate 74 is disposed coaxially on the heat transfer roller 53, in this example, so as to rotate in cooperation with the rotation of the heat transfer roller 53. That is, at one end of the drive shaft 61 of the heat transfer roller 53, the detecting plate (so-called encoder) 74 is provided so as to rotate together with the heat transfer roller 53 and detect the position of the notch 62 of the heat transfer roller 53 inclined by a specified angle θ (the position inclined by angle θ at first position contacting with the skirt 10 of the screen panel 3 at the time of transfer as mentioned below). This detecting plate 74 is a disk, and a linear slit 75 extending in the radial direction is formed at one position in its circumferential direction, and it is mounted on the drive shaft 61 so that the angle θ (see FIG. 14) formed by the slit 75 and one edge 62*a* of the notch 62 may be a specified angle, for example, 2 to 10°, or 5° in this example.

Figure 12:
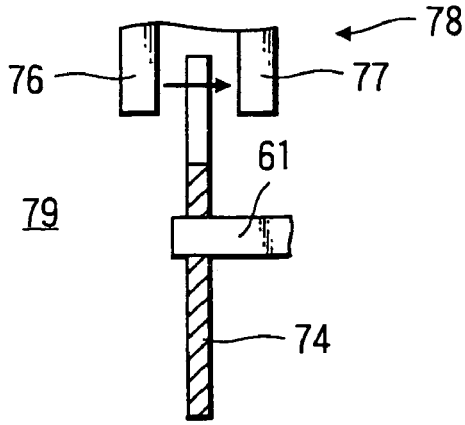
FIG. 12 is an explanatory diagram of rotating position detecting means of heat transfer roller of the transfer apparatus.

At both sides of the detecting plate 74, a photoelectric sensor 78 comprising a pair of light emitting element 76 and light receiving element 77 is disposed (see FIG. 10 and FIG. 12). In this case, when the slit 75 of the detecting plate 74 comes to the vertical position, the light from the light emitting element 76 is received in the light receiving element 77 through the slit 75, and it is detected that the notch 62 of the heat transfer roller 53 has come to the specified position inclined by angle θ. A motor 57 for rotating and driving the heat transfer roller 53 is provided at other end of the drive shaft 61 (see FIG. 10).

Together with the operation of the transfer apparatus 51, the transfer method is explained below.

Figure 14:
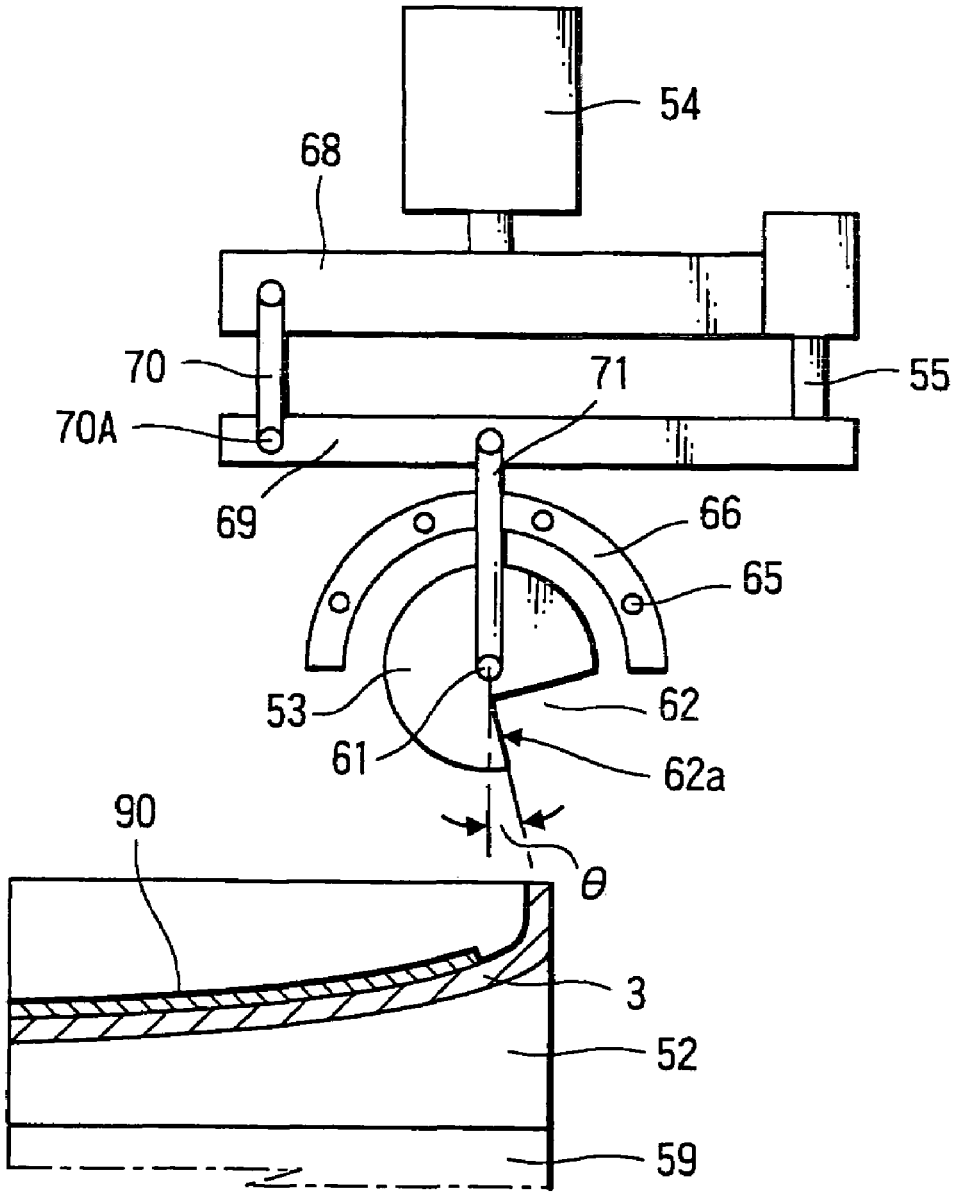
FIG. 14 is an operation process chart of the transfer apparatus in FIG. 8 (part 1)
Figure 15:
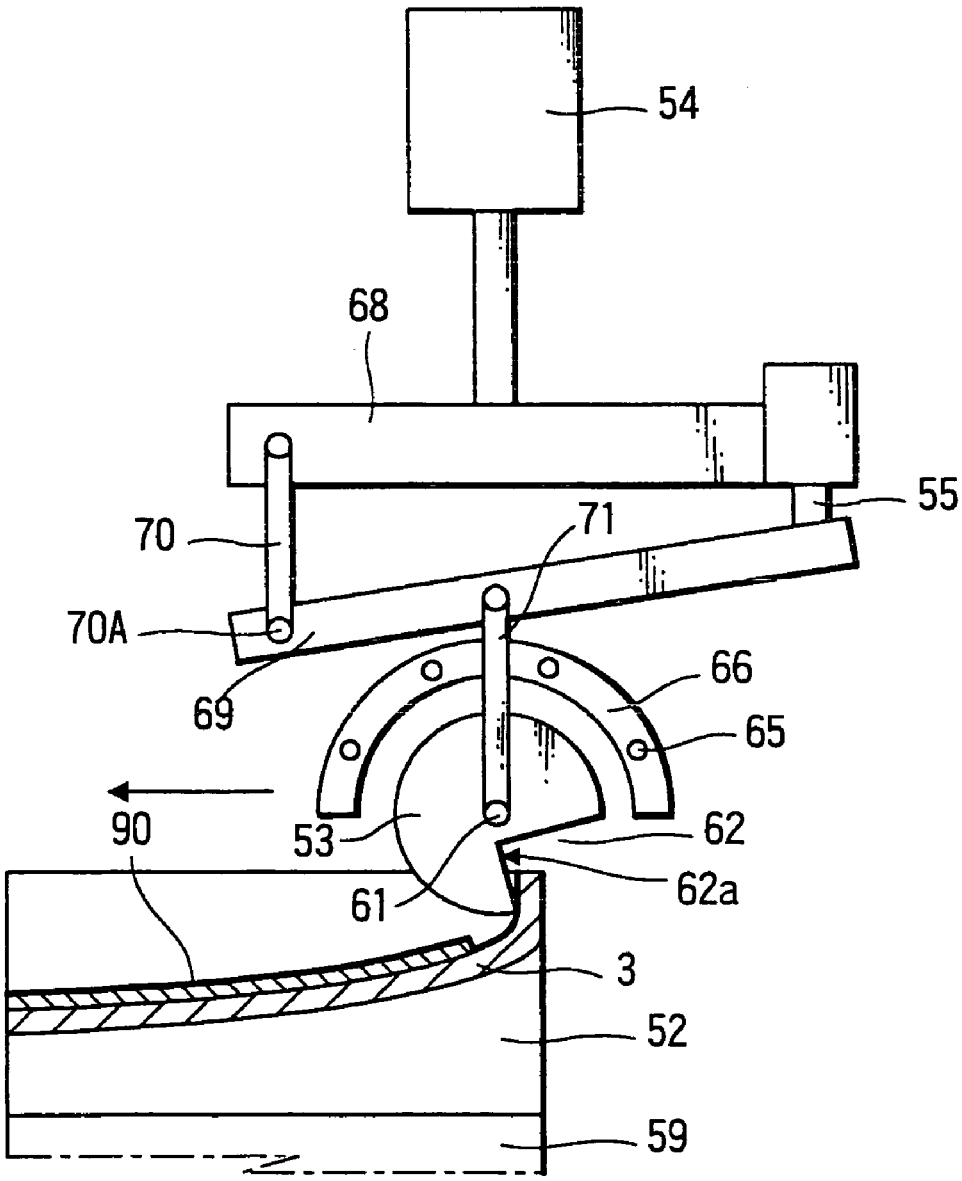
FIG. 15 is an operation process chart of the transfer apparatus in FIG. 9 (part 2)
Figure 16:
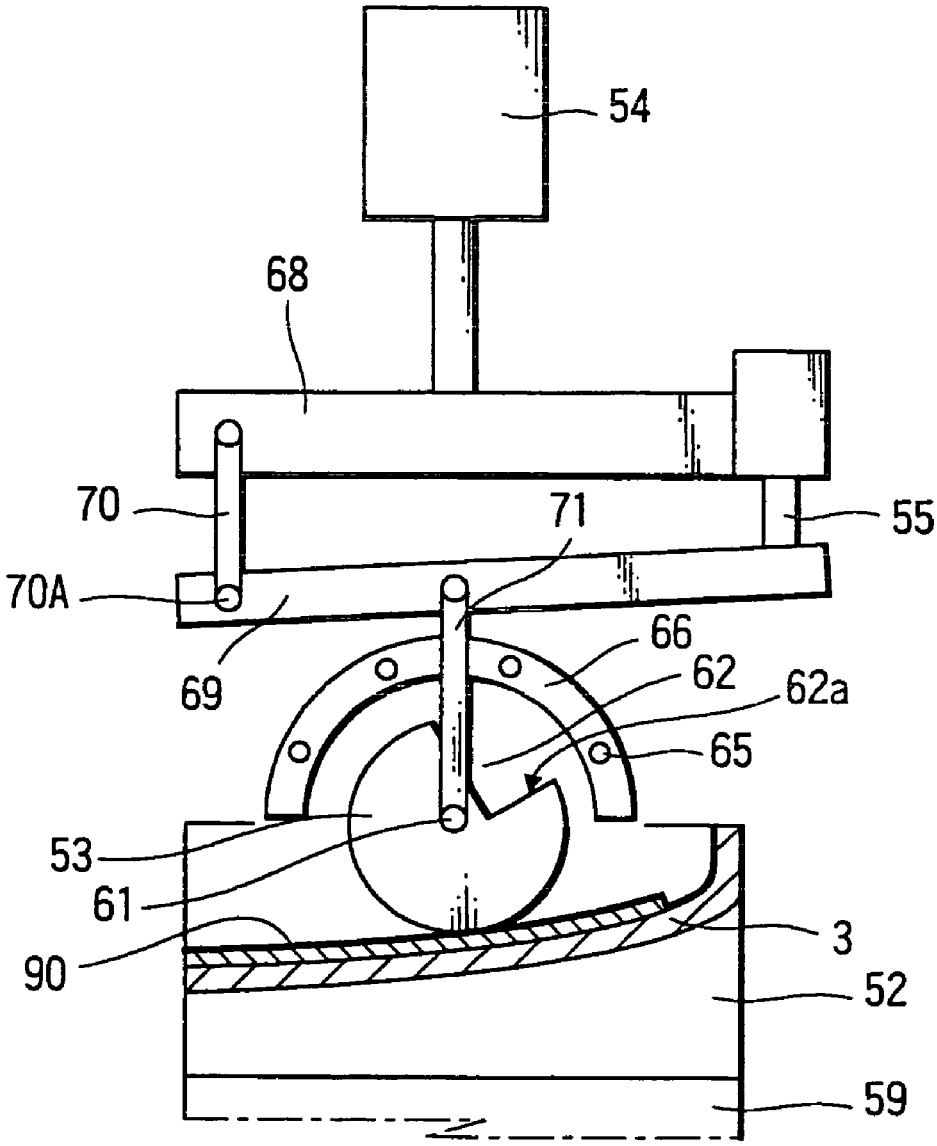
FIG. 16 is an operation process chart of the transfer apparatus in FIG. 9 (part 3)

FIG. 14 to FIG. 16 relate to a case of transfer of fluorescent screen at the inner side of the screen panel 3 by using a transfer foil 90 composed of sheets. In the case of transfer foil of sheet type, the transfer foil is supplied one by one together with the screen panel. As the transfer film 90, meanwhile, the transfer foils 21, 31 shown in FIG. 4 and FIG. 6 may be also used.

First, before start of transfer, the heat transfer roller 53 is rotating under temperature control. That is, the heat transfer roller 53 is rotating as being heated at specified temperature by the heating means 64, that is, in a state heated and adjusted to the peeling temperature of the transfer film of the transfer foil 90. The screen panel 3 for forming the fluorescent screen on is conveyed and set on the work holder 52. The transfer foil 90 is positioned, as being positioned at the inner side of the screen panel 3. When the transfer start switch is turned on, the work holder 52 is moved by the XY table 59, and the screen panel 3 is moved to a specified position immediately beneath the heat transfer roller 53.

A signal is received when the screen panel 3 is moved to the specified position, and preparation for start of the apparatus 51 is over.

Next, as shown in FIG. 14, the position of the slit 75 of the detecting plate 74 is detected by the detecting means 78, and it is noticed that the heat transfer roller 53 has come to the specified rotating position. At this time, the notch 62 of the heat transfer roller 53 corresponds to the upper end of the skirt 10 of the screen panel 3, and one edge 62*a* of the notch 62 is positioned at a position inclined, for example, by 5° to the vertical line. When the heat transfer roller 53 comes to this specified rotating position, the heating means 64 is turned off, and the rotation of the heat transfer roller 53 is stopped.

As shown in FIG. 15, consequently, the main cylinder 54 is driven, and the heat transfer roller 53 is lowered together with the fixed substrate 68, and its notch 62 is positioned on the upper end of the skirt 10, and the heat transfer roller 53 is pressed against the transfer start end of the transfer foil 90. At this time, since one edge 62*a* of the notch 62 is inclined by 5°, the edge of the notch 62 does not contact with the transfer foil 90 (especially its transfer layer), but the cylindrical surface contacts, so that the transfer foil 90 is not moved.

Figure 19:
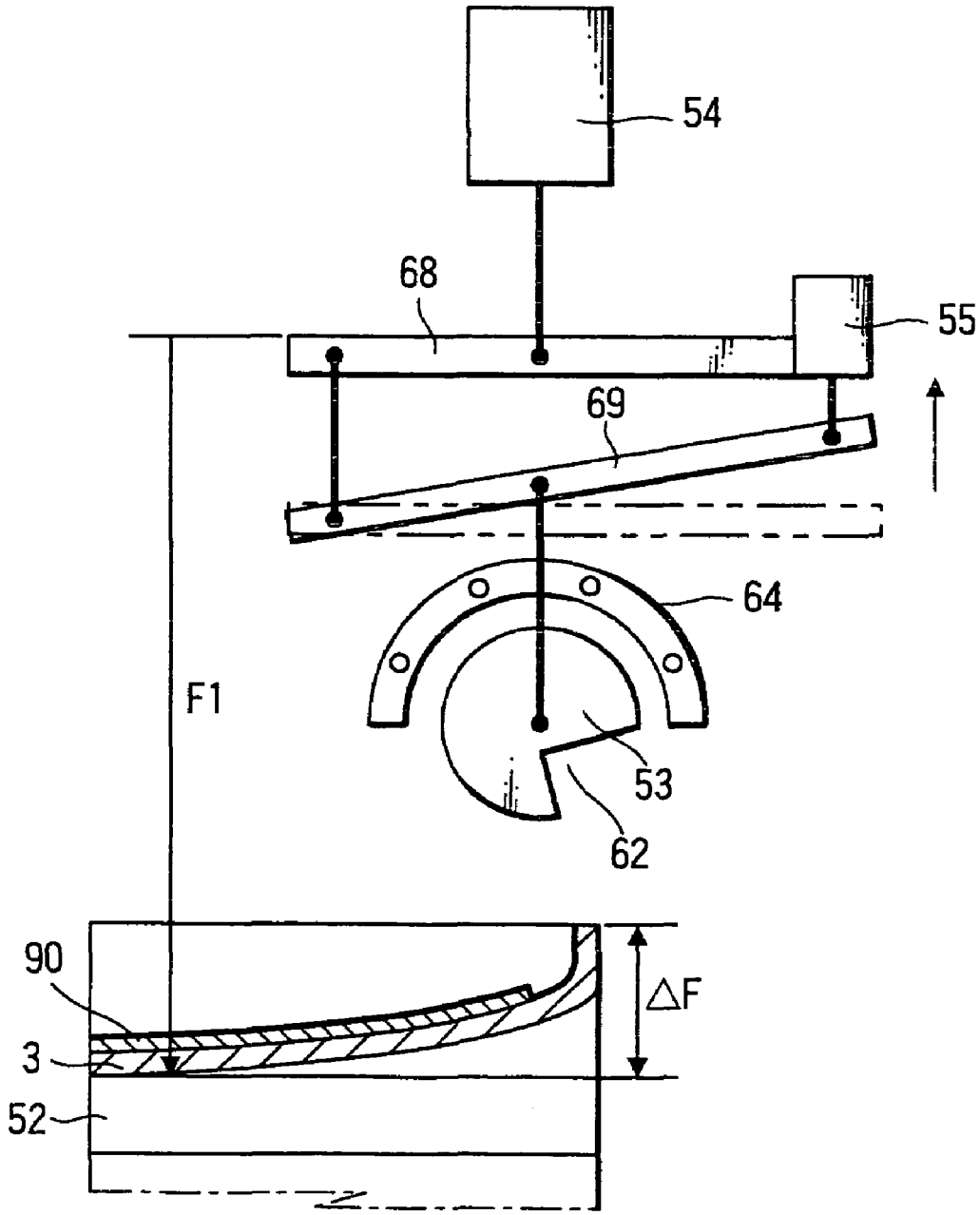
FIG. 19 is an operation explanatory diagram of the transfer apparatus in FIG. 9.

Meanwhile, as shown in FIG. 19, the pressure of the main cylinder 54 is preset at a pressure $F_1$ of the heat transfer roller 53 pressing against the lowest position $E_1$ of the screen panel 3. For example, it is set at about 10 kgf/cm$^2$. On the other hand, when the transfer pressure to the screen panel 3 at the time of transfer is set constantly at, for example, 4 kgf/cm$^2$ in the entire region, the pressure of the pressure control cylinder 55 is set at an intermediate pressure of the pressure of the main cylinder 54 and the transfer pressure.

Being determined in such pressure relation, as shown in FIG. 19, when the heat transfer roller 53 presses the skirt 10 by the main cylinder 54, the differential pressure ΔF is absorbed by the pressure control cylinder 55, and a specific pressure of 4 kgf/cm$^2$ is applied to the skirt 10. That is, by the portion corresponding to the differential pressure ΔF, the cylinder rod 55*a* of the pressure absorbing cylinder 55 retreats, and the movable member 69 rotates about the pivot 70A of the coupling member 70, and the heat transfer roller 53 is raised, so that the pressing force of the heat transfer roller 53 on the transfer foil 90 is maintained constantly at 4 kgf/cm$^2$.

Figure 17:
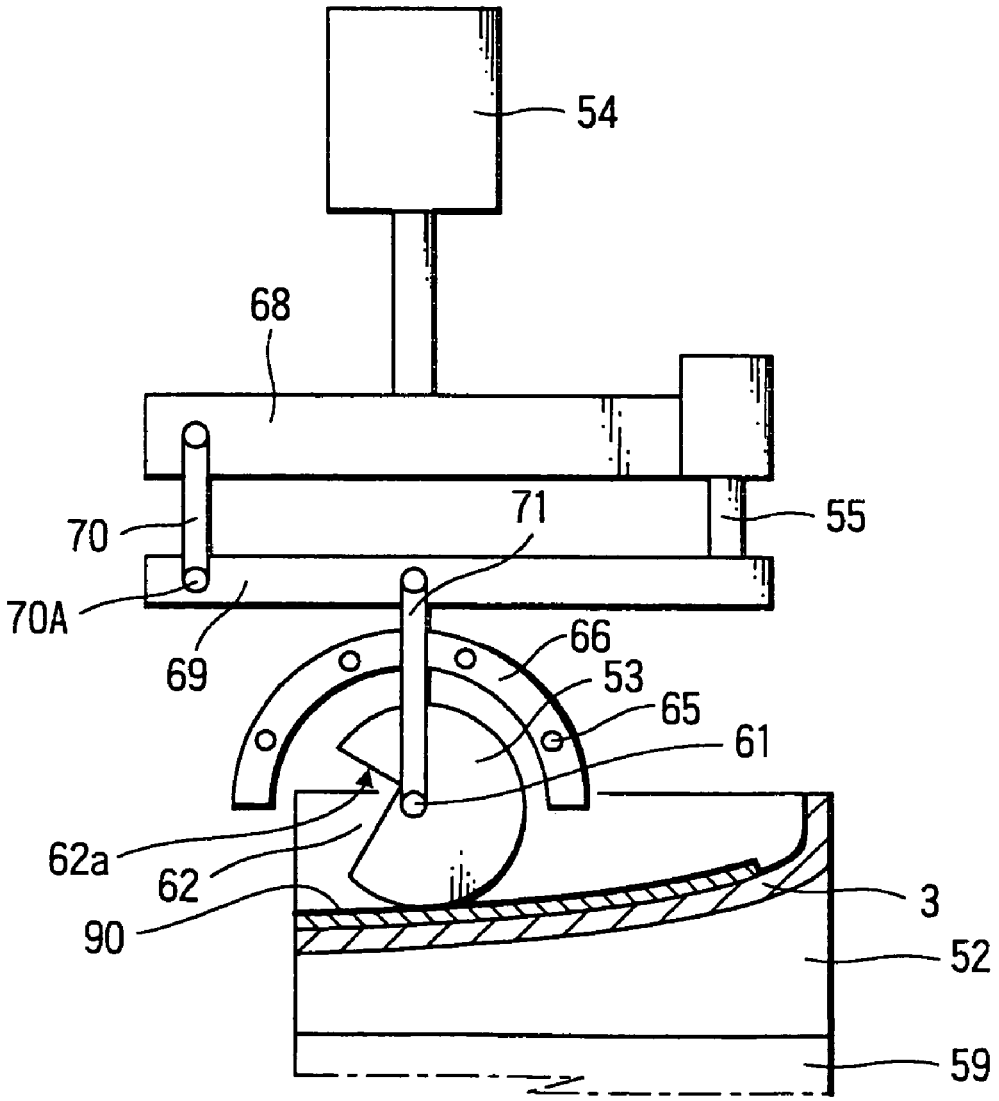
FIG. 17 is an operation process chart of the transfer apparatus in FIG. 9 (part 4)

As the moving means 56 is driven, in FIG. 16 and FIG. 17, the entire driving mechanism including the main cylinder 54 and heat transfer roller 53 moves from the skirt 10 to the funnel junction side at the inner side of the screen panel 3, that is, from right to left in the drawing. Along with this movement, the heat transfer roller 53 moves while rotating freely along the curved inner side of the screen panel 3, and applies a specific pressing force (for example, 4 kgf/cm$^2$) by the pressure control cylinder 55 and heats, so that the transfer foil 90 is adhered to the screen panel 3.

At this time, the heat transfer roller 53 rotates in the full width of the inner side of the screen panel 3, and by the function of the pressure control cylinder 55, the transfer foil is adhered uniformly even on the screen panel 3 having a three-dimensional curvature.

By moving the heat transfer roller 53 in one direction, the air between the transfer foil 90 and screen panel 3 escapes to the releasing end (junction with the front panel) side, and crease does not occur, and the transfer foil 90 is tightly adhered to the inner side of the screen panel 3. When the heat transfer roller 53 comes to the transfer terminal end of the screen panel 3 as shown in FIG. 17, the cylinder rod 54*a* of the main cylinder 54 retreats, and the heat transfer roller 53 ascends. Thus, adhesion of the transfer foil 90 to the inner side of the screen panel 3 is completed.

As a result, the heat transfer roller 53 resumes its rotation, and the heating means 65 is turned on and the temperature of the heat transfer roller 53 is adjusted. By the moving means 56, the entire driving mechanism including the main cylinder 54 and heat transfer roller 53 is moved from left to right, thereby returning to the waiting state.

The screen panel 3 is taken out, the transfer film of the transfer foil 90 is peeled off, and is baked in the heating process as mentioned above, and the organic matter in the transfer foil is removed, and a specified transfer layer, or a fluorescent screen in this example, is formed. That is, heat transfer of fluorescent screen at the inner side of the screen panel 3 is completed.

Figure 13A:
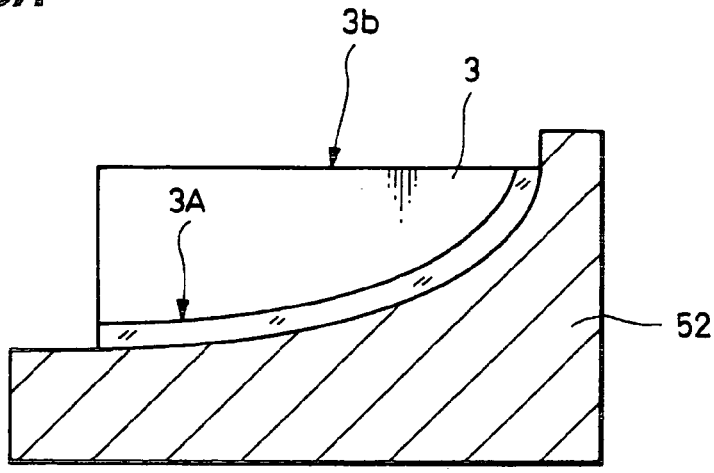
FIG. 13A is a sectional view showing an example of mounting of screen panel on a work holder in the transfer apparatus.
Figure 13B:
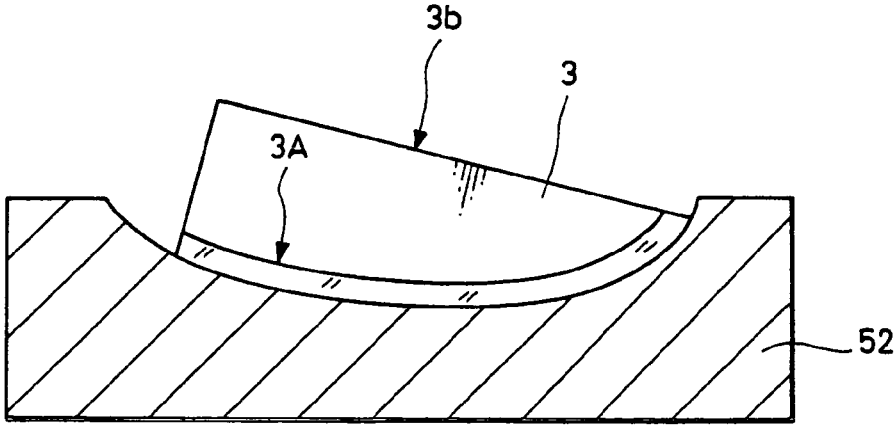
FIG. 13B is a sectional view showing other example of mounting of screen panel on a work holder in the transfer apparatus.
Figure 18:
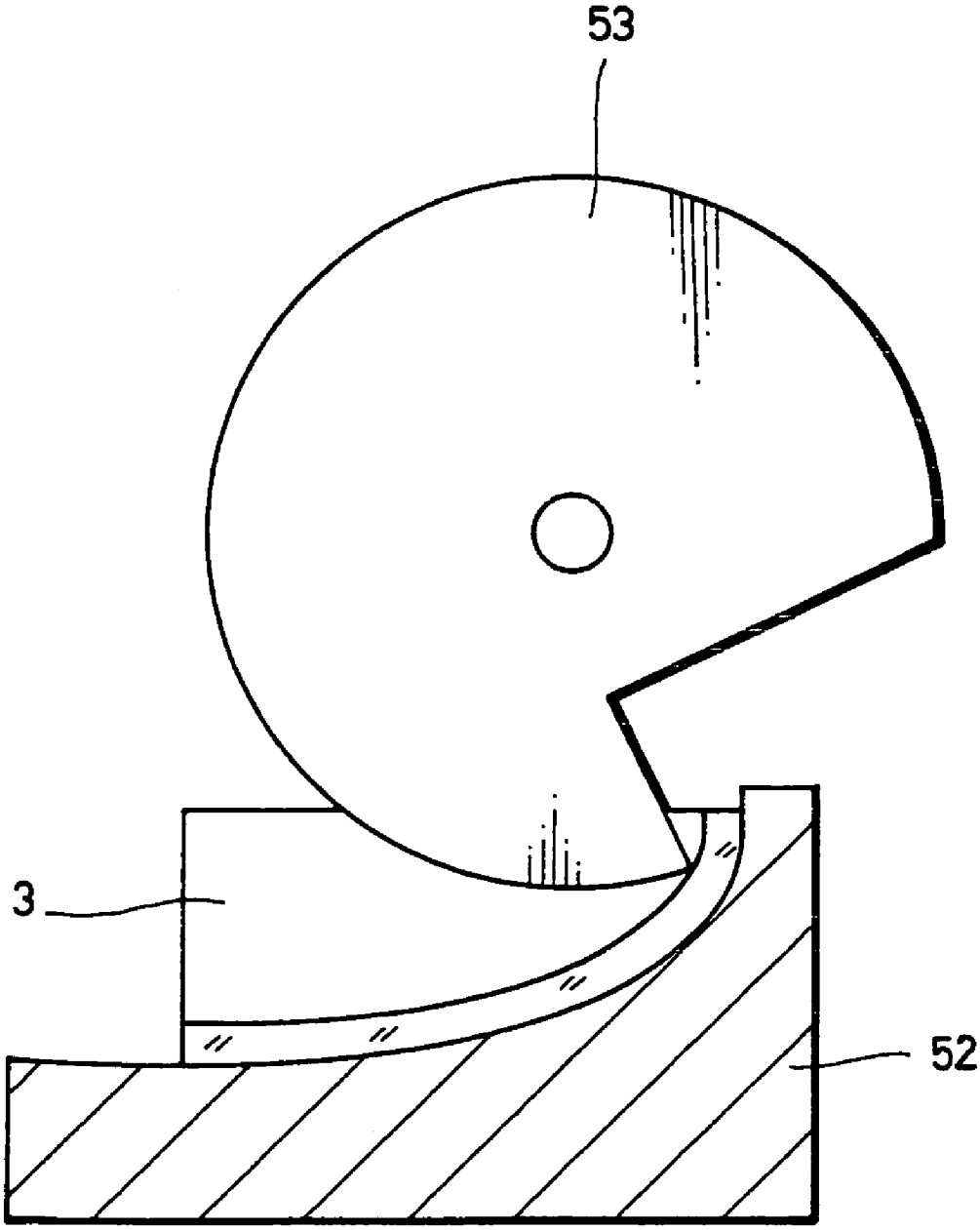
FIG. 18 is a magnified view of heat transfer roller and screen panel in the transfer apparatus.

In the actual transfer apparatus 51, as shown in FIG. 18, by rotation of the heat transfer roller 53 by 1/n (n being an integer), for example, the transfer foil is transferred to the inner side of the screen panel 3. The mounting method of the screen panel 3 on the work holder 52 includes a mounting method as shown in FIG. 13A, in which the screen panel 3 is set so that its junction 3*b* with the front panel 2 may be horizontal, and a mounting method as shown in FIG. 13B, in which the screen panel 3 is set so that its inner side (inner side to be transferred) 3A may be as horizontal as possible. In the mounting method in FIG. 13B, positioning of the screen panel 3 and transfer foil 90 is stable. It is the same in the transfer apparatus 100 mentioned later.

In the transfer apparatus 51 of the transfer foil 90 of sheet type of the embodiment, comprising the main cylinder 54 and pressure control cylinder 55, the pressure control cylinder 55 is varied according to the curved shape of the inner side of the screen panel 3, and the pressure applied to the screen panel 3 is controlled to be constant. Therefore, the pressing force of the main cylinder 54 can be controlled by the pressure control cylinder 55, and the transfer layer from the transfer foil 90 can be uniformly transferred to the surface of the screen panel 3 without applying excessive pressure to the screen panel 3 or without breaking the screen panel 3. In particular, in the case of the screen panel 3 of which transfer surface is a three-dimensional plane curved in X- and Y-directions, the transfer pressure is controlled depending on the shape of the screen panel, and the transfer foil 90 can be uniformly adhered to the inner side of the screen panel 3 while keeping constant the transfer pressure applied to the parts of the screen panel 3.

Since the notch 62 is provided along the axial direction on the surface corresponding to the rotating position upon start of transfer of the heat transfer roller 53, the end of the skirt 10 is set free by the notch 62 upon start of transfer, so that the heat transfer roller 53 contacts favorably with the inner side of the skirt 10 of the screen panel 3. At the same time, one edge 62*a* of the notch 62 is inclined by a specified angle θ to the vertical line, and the heat transfer roller 53 contacts with the inner side of the skirt 10, and therefore the cylindrical portion of the heat transfer roller 53 contacts with the portion corresponding to the transfer layer of the transfer foil 90, so that a stable adhesion is achieved. That is, it can avoid hitting of the edge of the notch 62 against the transfer foil to cause twisting or flaw of the transfer foil.

At the time of transfer, by moving the heat transfer roller 53 from the skirt 10 side to the funnel junction side at the inner side of the screen panel 3, the air between the transfer foil 90 and screen panel 3 escapes to the releasing end side, and crease does not occur, and the transfer foil 90 tightly contacts with the inner side of the screen panel 3, so that the transfer foil 90 can be adhered uniformly.

Since the transfer foil 90 is adhered by the heat transfer roller 53 from the skirt side of the screen panel 3 to the funnel along one direction toward the junction side, the transfer pressure is optimum, and the transfer layer (so-called fluorescent screen) is securely transferred from the initial end (upper end of screen) to the terminal end (lower end of screen) of the screen panel 3. Therefore, the upper edge line of the screen displaying the image after completion is kept accurately in linear form, and the appearance is improved. If there is fluctuation in the transfer pressure, part of the transfer layer is left over in the transfer foil, and, for example, the upper edge of the transferred transfer layer is uneven (for example, zigzag), and unevenness is obvious when the image is displayed, and it is handled as a defective piece.

The heat transfer roller 53 of the invention is designed to transfer one transfer foil by about a half rotation. When one notch 62 is formed in the heat transfer roller 53 (FIG. 11A), the transfer start point of the heat transfer roller 53 is one position, and the transfer efficiency is limited. By contrast, when two notches 62 are formed in the heat transfer roller 53 (FIG. 11B), the transfer start point of the heat transfer roller 53 is two positions, and hence the transfer efficiency is enhanced.

A detecting device 79 for detecting the rotating position of the notch 62 of the heat transfer roller 53 is provided, and its detecting plate 74 is mounted coaxially on the heat transfer roller 53, so that the rotating position upon start of transfer of the notch 62 of the heat transfer roller 53 can be positioned accurately.

FIG. 20 to FIG. 23 show the transfer apparatus and transfer method in other embodiment applicable to transfer of continuous transfer foil, or transfer layer from so-called roll transfer foil. This is an example of continuous transfer of fluorescent screen on at the inner side of the screen panel 3.

Figure 20:
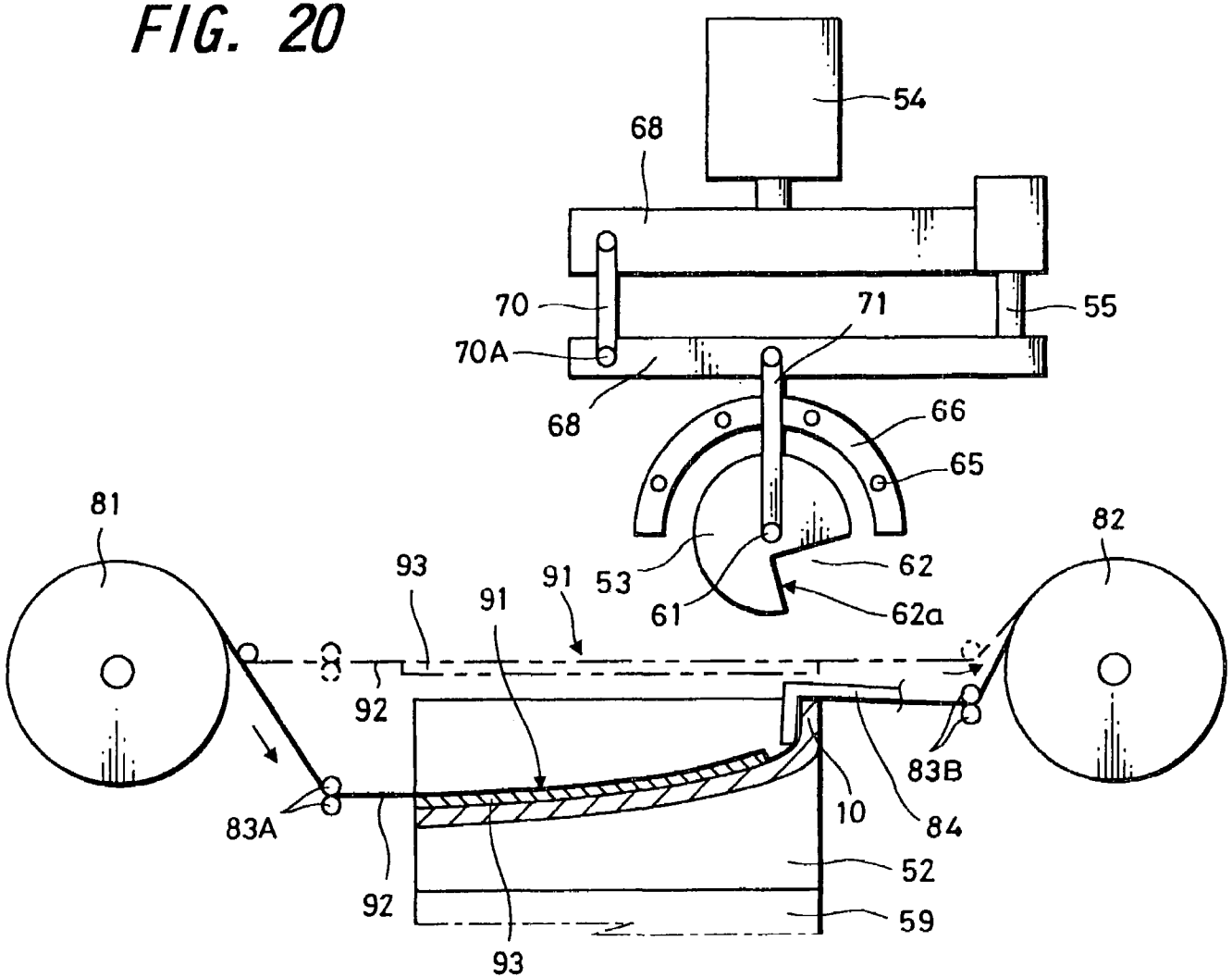
FIG. 20 is an operation process chart of other embodiment of transfer apparatus of the invention (part 1), shown together with a schematic structural view of essential parts.

A transfer apparatus 100 capable of transferring the fluorescent screen continuously comprises the means shown in FIG. 20 further, in addition to the transfer apparatus 51 in FIG. 9. That is, it further comprises a supply reel 81 for supplying a roll of transfer foil 90 forming plural transfer foil elements 93 on a continuous transfer film 92, a take-up reel 82 for taking up the peeled transfer film, transfer foil pressing guide means 83 [83A, 83B] composed of each pair of rolls disposed at the take-up reel 82 side for holding the parts of the transfer film 92 of the transfer foil 91, and transfer foil pressing means 84 for fixing one end of the transfer foil 91 at the upper end of the skirt 10 of the screen panel 3 to be transferred upon start of transfer, disposed near the work holder 52. As the transfer foil 91, the roll type transfer foil 41 explained in FIG. 8 may be used.

The transfer foil pressing guide means 83 has a function of guiding the transfer foil 91, ascending and pressing the transfer foil 91 to the inner side of the screen panel 3 when setting the transfer foil 91 to the inner side of the screen panel, and ascending and peeling the transfer film 92 at the end of transfer.

The transfer foil pressing means 84 is disposed in pair at positions corresponding to both ends in the axial direction of the screen panel 3, that is, at positions not interfering transfer of the heat transfer roller 53 to the transfer foil 91, so as to be capable of contacting with and departing from the screen panel 3.

The transfer foil 91 supplied from the supply reel 81 is given a back tension in a reverse direction of supply direction, and is designed to transfer and supply in a tense state without any looseness between the supply reel 81 and take-up reel 82.

The other structure is same as in the transfer apparatus 51 in FIG. 9, and same reference numbers are given to the corresponding parts, and duplicate explanation is omitted.

The operation of this transfer apparatus 100 and its transfer method are as follows.

Same as in the foregoing examples, the heat transfer roller 53 is rotating as being heated and adjusted to the specified peeling temperature of the transfer film 92 of the transfer foil 91 by the heating means 64, that is, it is in waiting state. The screen panel 3 for forming the fluorescent screen is conveyed and set on the work holder 52. When the transfer start switch is turned on, the work holder 52 is moved by the XY table, and the screen panel 3 is moved to beneath the transfer foil 91, that is, to a specified position immediately beneath the heat transfer roller 53.

Next, as shown in FIG. 20, the transfer foil pressing means 84 descends, and the transfer foil 91 is pressed to the upper end of the skirt 10 of the screen panel 3 by the transfer foil pressing means 84. The transfer foil pressing guide means 83 [83A, 83B] descends in a state of holding the transfer foil 91, and the transfer foil element 93 of the transfer foil 91 is held at the inner side of the screen panel 3. Otherwise, the transfer foil pressing means 84 and transfer foil pressing guide means 83 may be driven simultaneously.

Thereafter, the same operation as in the foregoing examples is carried out. That is, the position of the slit 75 of the detecting plate 74 is detected by the detecting means 78, and it is noticed that the heat transfer roller 53 has come to the specified rotating position. As a result, the edge 62*a* of the notch 62 of the heat transfer roller 53 is positioned at the upper end of the skirt 10 of the screen panel 3 in a state inclined, for example, by 5° to the vertical line. The heating means 64 is turned off, and the rotation of the heat transfer roller 53 is stopped (the state in FIG. 20).

Figure 21:
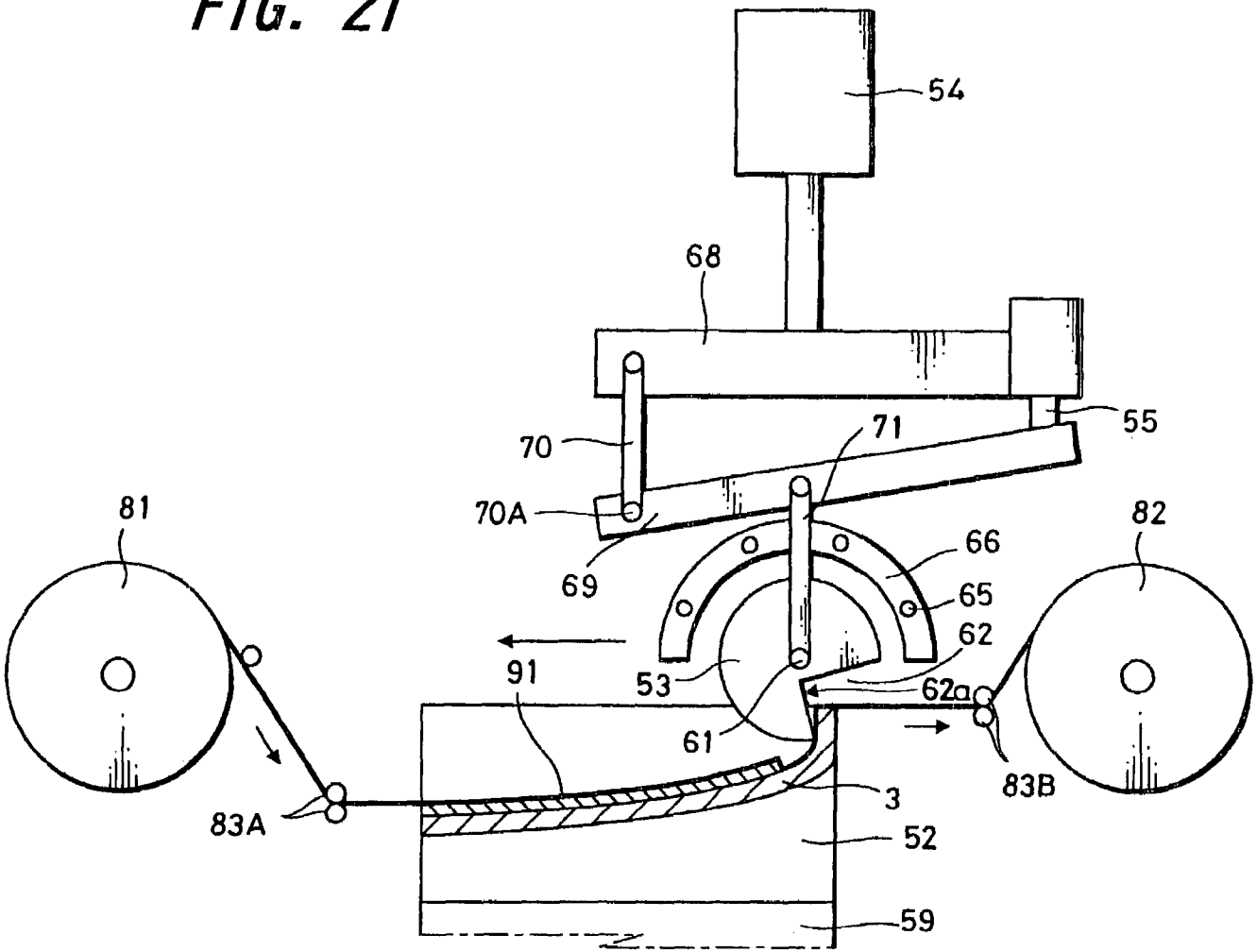
FIG. 21 is an operation process chart of the transfer apparatus in FIG. 20 (part 2)

As shown in FIG. 21, consequently, the main cylinder 54 is driven, and the heat transfer roller 53 is lowered together with the fixed substrate 68, and its notch 62 is positioned on the upper end of the skirt 10, and the heat transfer roller 53 is pressed against the transfer start end of the transfer foil 90. By the main cylinder 54, the heat transfer roller 53 is pressed against the skirt 10 of the screen panel 3 through the transfer foil 91, and as explained in FIG. 19, the differential pressure AF is absorbed by the pressure control cylinder 55, and the heat transfer roller 53 presses the transfer foil 91 at a specific transfer pressure.

Figure 22:
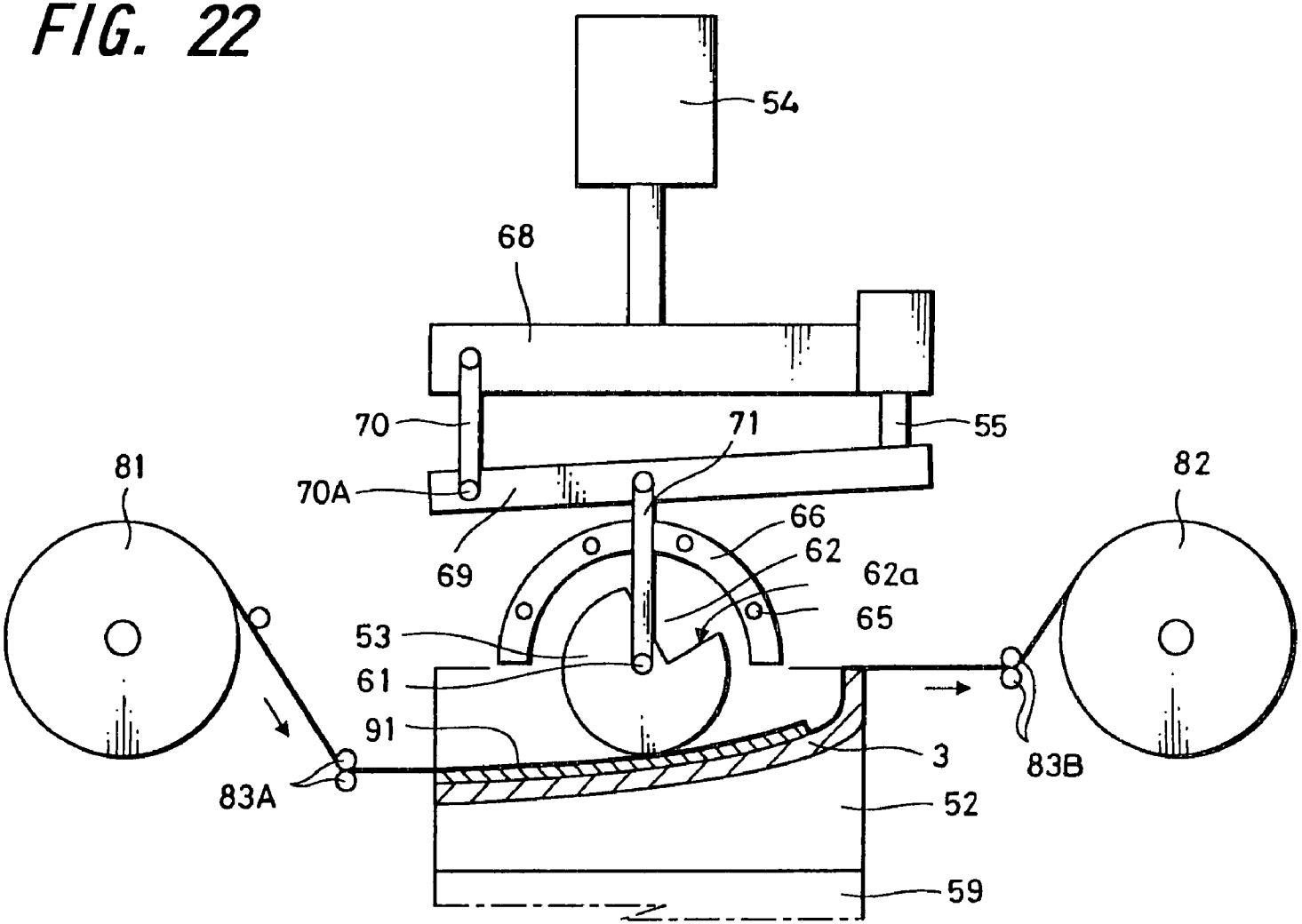
FIG. 22 is an operation process chart of the transfer apparatus in FIG. 20 (part 3)
Figure 23:
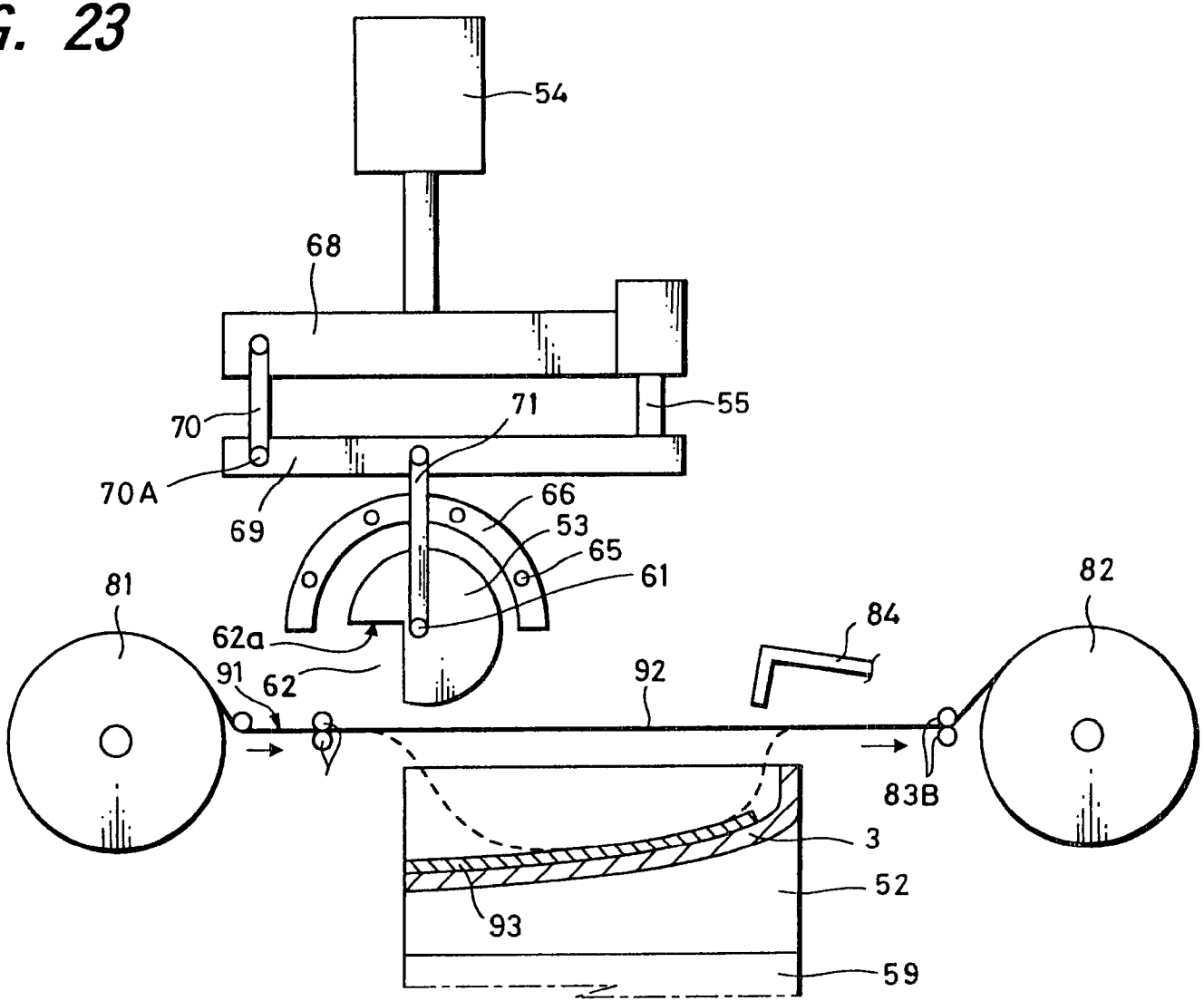
FIG. 23 is an operation process chart of the transfer apparatus in FIG. 20 (part 4).

Consequently, the moving means 56 moves, and the entire driving mechanism including the main cylinder 54 and heat transfer roller 53 moves from right to left in FIG. 21 and FIG. 22. Along with this movement, the heat transfer roller 53 moves while rotating along the curved inner side of the screen panel 3, and applies a specific transfer pressure by the pressure control cylinder 55 and heats, so that the transfer foil 91 is adhered to the screen panel 3. When the heat transfer roller 53 comes to the transfer terminal end of the screen panel 3, the cylinder rod 54*a* of the main cylinder 54 retreats, and the heat transfer roller 53 ascends as shown in FIG. 23. Thus, adhesion of the transfer foil 91 to the inner side of the screen panel 3 is completed.

Again, the heat transfer roller 53 resumes its rotation, and the heating means 65 is turned on and the temperature of the heat transfer roller 53 is adjusted. Successively, the transfer foil pressing means 84 and transfer foil pressing guide 83 are raised simultaneously, and return to the original positions. When the transfer foil pressing guide means 83 returns, the transfer film 92 is peeled from lower to upper direction at the same time (the state in FIG. 23).

By the moving means 56, the entire driving mechanism including the main cylinder 54 and heat transfer roller 53 is moved from left to right, thereby returning to the waiting state. Then, the roll of the transfer foil 91 is taken up on the take-up reel 82, and a next transfer foil element 92 is sent in, and the same operation is repeated, and the transfer is done continuously.

Next, the screen panel 3 is taken out from the work holder 52, and the screen panel 3 is heated as mentioned above, and heat transfer of fluorescent screen at the inner side of the screen panel 3 is completed.

In the transfer apparatus 100 using the transfer foil 91 of roll type of the embodiment, comprising the main cylinder 54 and pressure control cylinder 55 same as in the foregoing embodiment, the pressure control cylinder 55 is varied according to the curved shape of the inner side of the screen panel 3, and the pressure applied to the screen panel 3 is kept to be constant, and the transfer foil 91 can be adhered uniformly to the inner side of the screen panel 3.

Since the transfer foil pressing guide means 83 is disposed movably up and down, when adhering the transfer foil 91, the transfer foil 91 is pressed favorably to the screen panel 3, and after adhering the transfer foil 91, the transfer film 92 can be automatically peeled, so that the transfer job can be done smoothly.

When starting the transfer of the transfer foil 91, since the end of the transfer foil 91 is firmly adhered tightly to the skirt 10 by the transfer foil pressing means 84 (that is, there is no loosening of transfer foil), bubbles are not mixed in between the transfer foil 91 and screen panel 3 in the subsequent process of adhesion by the heat transfer roller 53, so that favorable adhesion free from crease is realized.

In this transfer apparatus 100, preferably, the take-up reel 82 should be disposed at the transfer foil pressing means 84 side; so that the transfer foil 91 may be moved in a reverse direction of the moving direction of the heat transfer roller 53. When setting the transfer foil 91 on the screen panel 3, since the take-up reel 82 is in stopped state, by disposing the take-up reel 82 at the transfer foil pressing means 84 side, the transfer foil 91 is not deviated when the transfer foil 91 is pressed by the transfer foil setting means 84 at the time of setting, and therefore the transfer foil element (that is, the transfer layer) 93 can be positioned correctly at the upper end position when setting the transfer foil. Accordingly, the transfer foil element 93 is not deviated in position, and can be transferred correctly at specified position of the screen panel 3.

The supply reel 81 and take-up reel 82 can be disposed in reverse direction of the sheet type.

According to the transfer method of the embodiment using the transfer apparatus 51 or 100, using the heat transfer roller 53, while the pressing force by the main cylinder 54 is absorbed by the pressure control cylinder 55, and the transfer pressure of the heat transfer roller 53 is controlled, the transfer foils 90, 91 are transferred on the screen panel 3, the transfer layers from the transfer foils 90, 91 can be uniformly transferred to the parts of the screen panel 3.

In the screen panel 3 having the skirt 10 at least at one side, by moving the heat transfer roller 53 from the skirt 10 side to the other side, the transfer foils 90, 91 can be adhered without forming crease, and the transfer layers from the transfer foils 90, 91 can be transferred uniformly.

By detecting the rotating position of the notch 62 formed in the heat transfer roller 53, since transfer of the transfer foils 90, 91 is started by setting the notch 62 corresponding to the skirt 10 of the screen panel 3, the transfer initial end can be adjusted correctly.

The transfer apparatuses 51, 100 of the embodiments are not limited to transfer of fluorescent screen, but may be applied also to transfer to other desired transfer layer.

The transfer apparatuses 51, 100 and the transfer methods of the embodiments are particularly applicable preferably in transfer of three-dimensional curve, not limited to the plane screen panel such as flat cathode-ray tube.

In the transfer foil of the invention, since at least the fluorescent layer, reflective layer, and grid layer are laminated and formed on the transfer substrate, the fluorescent screen can be formed by batch transfer by using this transfer foil, and uniformity of properties of films composing the fluorescent screen can be assured.

When the reflective layer is formed at the inner side of the circumference of the fluorescent layer, while the transfer foil is formed by laminating the fluorescent layer, reflective layer, and grid layer, the reflective layer does not project outside of the fluorescent layer if heat transferred on the panel by using this transfer foil, and the fluorescent screen of excellent visual recognition of the display image, that is, display quality is manufactured.

When the reflective layer is formed of a white inorganic layer, the periphery of the image does not appear as a white frame, and the fluorescent screen of excellent display quality is manufactured.

When the reflective layer is formed of a titanium oxide layer, the refractive index is high and reflection efficiency is excellent, and the screen is heightened in brightness. Moreover, the fluorescent screen can be manufactured inexpensively.

When the reflective layer is formed of an aluminum layer, shining frame is not displayed around the image, and the fluorescent screen of excellent display quality is manufactured.

When the grid layer is formed of a mixed material of grid component and adhesive component, the adhesive layer can be omitted, and the number of layers for composing the transfer foil can be decreased, so that the manufacturing process of the transfer foil can be simplified.

When the transfer foil is composed by laminating a fluorescent layer and an electrically conductive reflective layer, the grid is omitted, and the film structure of the transfer foil is simplified. Besides, by forming this reflective film at the inner side of the circumference of the fluorescent layer, the fluorescent screen of excellent visual recognition of the display image, that is, display quality is manufactured.

According to the transfer method of the invention, since the transfer layer from the transfer foil is transferred on the object of transfer while controlling the transfer pressure of the heat transfer roller, uniform transfer is possible.

Since the transfer pressure of the heat transfer roller is controlled by pressing force by main pressing means and pressure control means for controlling the pressing force of the main pressing means, transfer on a three-dimensional curvature can be done favorably.

In the transfer apparatus of the invention, since it comprises at least the heat transfer roller, and pressing means having a control function for controlling the transfer pressure of the heat transfer roller, the transfer layer from the transfer foil can be transferred uniformly on the object of transfer without applying excessive pressure to the object of transfer. In particular, in the case of the object of transfer of which surface of transfer has a three-dimensional curvature, the transfer pressure is controlled depending on the shape of the object of transfer, and the transfer layer from the transfer foil can be uniformly transferred on the three-dimensional curvature while keeping constant the transfer pressure applied to the parts of the object of transfer.

A notch is formed along the axial direction on a surface of the heat transfer roller corresponding to the rotating position upon start of transfer, and therefore when transferring the transfer foil on the object of transfer having a riser part, the end portion of the riser part is set free by the notch, and rolling of the heat transfer roller on the riser part is smooth, so that uniform transfer is realized.

Further, since the rotation starting position of the heat transfer roller of the notch of the heat transfer roller upon start point of transfer is set at an inclination of a specific angle to the vertical line, the edge of the notch does not contact with the portion corresponding to the transfer layer of the transfer foil, so that soiling or flawing of transfer foil can be avoided.

The transfer apparatus and transfer method of the invention are ideal when applied in transfer of transfer foil on an object of transfer having a three-dimensional curvature, such as a screen panel of a flat cathode-ray tube.

According to the flat cathode-ray tube of the invention, since the fluorescent screen is formed of grid layer, reflective layer and fluorescent layer by transfer from transfer foil, uniformity of properties of films for composing the fluorescent screen can be assured, and a flat cathode-ray tube stable in image display quality can be presented.

On the fluorescent screen, when the reflective layer is formed at the inner side of the circumference of the fluorescent layer, the reflective layer does not project to display an undesired frame around the image, and the visual recognition of the display image, that is, display quality can be enhanced.

When the reflective layer is formed of a white inorganic layer, the periphery of the image does not appear as a white frame, and the display quality is improved.

When the reflective layer is formed of a titanium oxide layer, the reflection efficiency is high, and a screen of high brightness is obtained. Moreover, the fluorescent screen can be manufactured inexpensively.

When the reflective layer is formed of an aluminum layer, shining frame is not displayed around the image, and the display quality is improved.

When the fluorescent screen is formed of an electrically conductive reflective layer and a fluorescent layer, the grid layer is omitted, and the film structure of the fluorescent screen is simplified. Besides, by forming this reflective film at the inner side of the circumference of the fluorescent layer, the visual recognition of the display image, that is, display quality can be improved.

According to the manufacturing method of flat cathode-ray tube of the invention, the fluorescent screen is uniform in film properties of individual layers, and is hence manufactured by batch transfer. Therefore, the flat cathode-ray tube of excellent quality of fluorescent screen can be manufactured easily.

Using a transfer foil formed by laminating a fluorescent layer, a reflective layer, and a grid layer on a transfer substrate, a fluorescent screen is fabricated at the inner side of a screen panel by batch transfer method, and therefore the manufacturing process of fluorescent screen can be shortened and the film properties of layers for composing the fluorescent screen can be made uniform. Therefore, a flat cathode-ray tube of high reliability can be manufactured easily.

By using the transfer foil laminating the fluorescent layer, reflective layer and grid layer, and having the reflective layer formed at the inner side of the circumference of the fluorescent layer, a flat cathode-ray tube improved in the visual recognition of the display image, that is, display quality can be manufactured easily.

By using the transfer foil of which reflective layer is formed of a white inorganic layer, the periphery of the image does not appear as a white frame, and the flat cathode-ray tube of excellent display quality is manufactured.

By using the transfer foil of which reflective layer is formed of a titanium oxide layer, the reflection efficiency is high, and a fluorescent screen of high brightness is formed, so that the flat cathode-ray tube of excellent display quality is manufactured.

By using the transfer foil of which reflective layer is formed of an aluminum layer, shining frame is not displayed around the image, and the flat cathode-ray tube of excellent display quality is manufactured.

By using the transfer foil formed by laminating a fluorescent layer and an electrically conductive reflective layer, the grid layer is omitted, and the fluorescent screen of a simplified film structure is formed. Besides, by using the transfer foil of which reflective film is formed at the inner side of the circumference of the fluorescent layer, the flat cathode-ray tube enhanced in the visual recognition of the display image, that is, display quality can be manufactured easily.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A flat cathode-ray tube comprising:

a transfer foil having a fluorescent layer and a reflective layer, said reflective layer being between said fluorescent layer and a screen panel, the total surface area of said reflective layer being smaller than the total surface area of said fluorescent layer, wherein:

said transfer foil includes a grid layer between said reflective layer and said screen panel, said transfer foil further includes an adhesive layer between said grid layer and said screen panel, said grid layer, said reflective layer and said fluorescent layer is adhered to said screen panel through said the adhesive layer, a peripheral edge of said fluorescent layer extends beyond a peripheral edge of said reflective layer, and said reflective layer is one of a titanium oxide layer, an aluminum oxide layer, a tin oxide layer, a zinc sulfide layer, a barium sulfate layer, a calcium carbonate layer, magnesium oxide layer, and an aluminum layer.

* * * * *